US005755196A

United States Patent [19]

Klassen

[11] Patent Number: 5,755,196

[45] Date of Patent: May 26, 1998

[54] ROTARY POSITIVE DISPLACEMENT ENGINE

[75] Inventor: James Klassen, Calgary, Canada

[73] Assignee: Outland Design Technologies, Inc., Lynden, Wash.

[21] Appl. No.: 401,264

[22] Filed: Mar. 9, 1995

[51] Int. Cl.[6] ..... F02G 3/00; F01C 3/06

[52] U.S. Cl. ..... 123/204; 418/195

[58] Field of Search ..... 123/204; 418/195

[56] References Cited

U.S. PATENT DOCUMENTS

| | | | |
|---|---|---|---|
| 32,372 | 5/1861 | Jones et al. | 418/195 |
| 351,129 | 10/1886 | Salomo | 418/195 |
| 2,101,051 | 12/1937 | Cuny | 418/195 |
| 2,101,428 | 12/1937 | Cuny | 418/195 |
| 2,242,058 | 5/1941 | Cuny | 418/195 |
| 3,101,700 | 8/1963 | Bowdish | 418/195 |
| 3,106,912 | 10/1963 | Kahlert | 418/195 |
| 3,156,222 | 11/1964 | Miller . | |
| 3,236,186 | 2/1966 | Wildhaber | 418/195 |
| 3,816,038 | 6/1974 | Berry | 418/68 |
| 3,856,440 | 12/1974 | Wildhaber | 418/195 |

FOREIGN PATENT DOCUMENTS

| | | | |
|---|---|---|---|
| 2069607 | 11/1993 | Canada | 418/195 |
| 916277 | 8/1946 | France | 418/195 |
| 1551081 | 4/1970 | Germany . | |
| 26 39 760 | 9/1976 | Germany . | |
| 3221994 | 12/1983 | Germany | 418/195 |
| 268459 | 10/1929 | Italy | 418/195 |
| 55-72683 | 5/1980 | Japan | 418/195 |
| 805370 | 12/1958 | United Kingdom . | |
| 1099085 | 1/1968 | United Kingdom . | |

OTHER PUBLICATIONS

Excerpt from a book titled "Rotary Piston Machines" by Felix Wankel, Classification of design principles for engines, pumps and compressors, 16 pages, 1965.

Granco Positive Displacement Rotary Pump product brochure, 6 pages, with attached article, Principles of operation and performance characteristics of Rotary Ball Pumps by Michael L. George, Challenge Manufacturing Co. Inc. Oakland, CA, 4 pages, Plant Engineering, Dec. 10, 1981.

*Primary Examiner*—Michael Koczo

*Attorney, Agent, or Firm*—Todd N. Hathaway

[57] ABSTRACT

An engine has a pair of rotors, both housed within the same housing. The housing has an interior cavity which is preferably spherical but need only be partially spherical, the remainder at least having rotational symmetry. Each rotor is mounted on an axis that passes through the center of the cavity, the respective axes of the rotors being at an angle to each other, with the center of each rotor being at the center of the cavity. The rotors interlock with each other to define chambers. Vanes or pistons defined by a contact face and a side face protrude from the rotors. The side faces and contact faces, and the housing interior define chambers that open and close as the rotors rotate. Each contact face of one rotor is defined by the rotation of a conical section of material on the other rotor, so that there is constant linear contact between opposing vanes on the two rotors, at least on one side of the engine. The rotors may face each other or be one inside the other. When one is inside the other, the engine may be used in association with an external combustor. Bearings support the rotors for rotation, and ports are used to allow gases into and out of the chambers.

43 Claims, 16 Drawing Sheets

ROTARY POSITIVE DISPLACEMENT ENGINE

FIELD OF THE INVENTION

This invention relates to rotary positive displacement engines, and to a method of making rotary positive displacement engines.

BACKGROUND AND SUMMARY OF THE INVENTION

This invention concerns an advanced rotary positive displacement engine having high power to mass ratio and low production cost. Engine as used in this patent document is taken to be a device that converts one form of energy into another. An exemplary pump and an exemplary external combustion engine are disclosed embodying the novel design principles of the invention.

In the case of prior art combustion engines, the reciprocating piston type is most widely used for its low cost of production and efficient sealing, while the turbine has shown that an external combustion engine may offer greater power partially from high speed. Rotary engines such as the Wankel engine have shown higher power to weight ratios than reciprocating engines but at the expense of increased fuel consumption. The present invention is a rotary device that offers many of the advantages of these prior art devices without many of their shortcomings.

In the case of pumps, there are many general types of pump design known, such as positive displacement, centrifugal and impeller. Pumps of the positive displacement type are typically reciprocating or rotary.

Many previous rotary combustion engine designs have been of the single plane type in which rotary motion occurs about axes that are parallel to each other.

The present invention is of the rotary positive displacement type, but is in a class by itself. This rotary positive displacement device is believed to be the first rotary engine in which the axes of the moving parts are offset from each other and the moving parts rotate at a constant velocity relative to each other when they are rotating at a constant velocity relative to the casing. The engine is formed by a pair of facing rotors that are axially offset from another and whose faces define chambers that change volume with rotation of the rotors.

An engine of this type defines a new class of engines, and includes a minimum number of moving parts, namely as few as two in total.

In one aspect of the invention, a pump includes a pair of rotors, both housed on and preferably within the same housing. The housing has an interior cavity having a center. Each rotor is mounted on an axis that passes through the center of the cavity, the respective axes of the rotors being at an angle to each other, with the center of each rotor being at the center of the cavity. The rotors interlock with each other to define chambers. Vanes defined by a contact face on one side of the vane and a side face on the other side of the vane protrude from the rotors. Each contact face of one rotor is defined by the rotation of a conical section of material at the tip of a vane on the other rotor, so that there is constant linear contact between opposing vanes on the two rotors as they rotate. The side faces are preferably concave and extend from an inner end of one contact face to the outer end of an adjacent contact face, equivalent to the tip of a vane. The side faces and contact faces define walls of chambers that change volume as the rotors rotate. Ports for intake and exhaust are preferably configured to have shapes complementary to the intersecting vanes of the rotors.

In a further aspect of the invention, an external combustion engine is provided in which one power rotor having an axis A rotates within a passive rotor having axis B offset to axis A. The rotors share a common center, and the axes intersect at the common center. Pistons extend radially from the power rotor into cylinders formed in the passive rotor. The pistons contact the walls of the cylinder on 180° of rotation (top to bottom) and do not contact on the next 180° of rotation (bottom to top). As the rotors rotate, the pistons move axially within the cylinders changing the volume of the chambers inside the cylinders.

These and other aspects of the invention will be described in more detail in what follows and claimed in the claims appearing at the end of this patent document.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

In discussing the rotors used in the engines described here, reference will be made to "top" and "bottom". Points on a line bisecting the larger angle formed between offset intersecting axes A and B in the plane defined by axes A and B will be referred to as being at the "top", while points on the extension of that line bisecting the acute angle between axes A and B will be referred to as being at the "bottom".

Figure 7A:
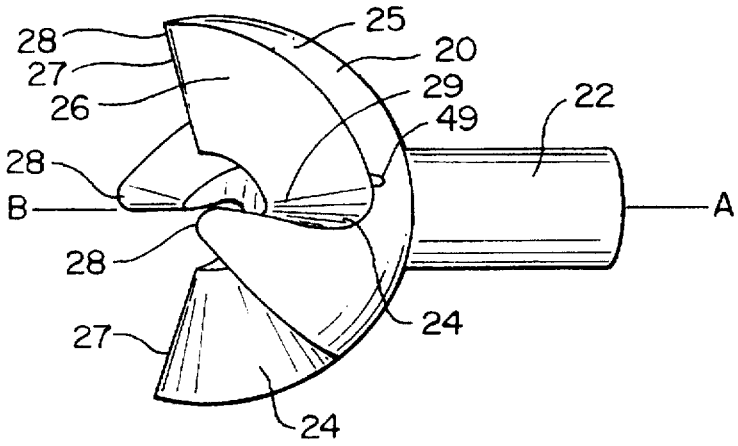
FIG. 7A is a top view of the master rotor of FIG. 6A showing the result of removing material from the master rotor between four vanes one face of each vane being formed as shown in the preceding Figures.
Figure 8:
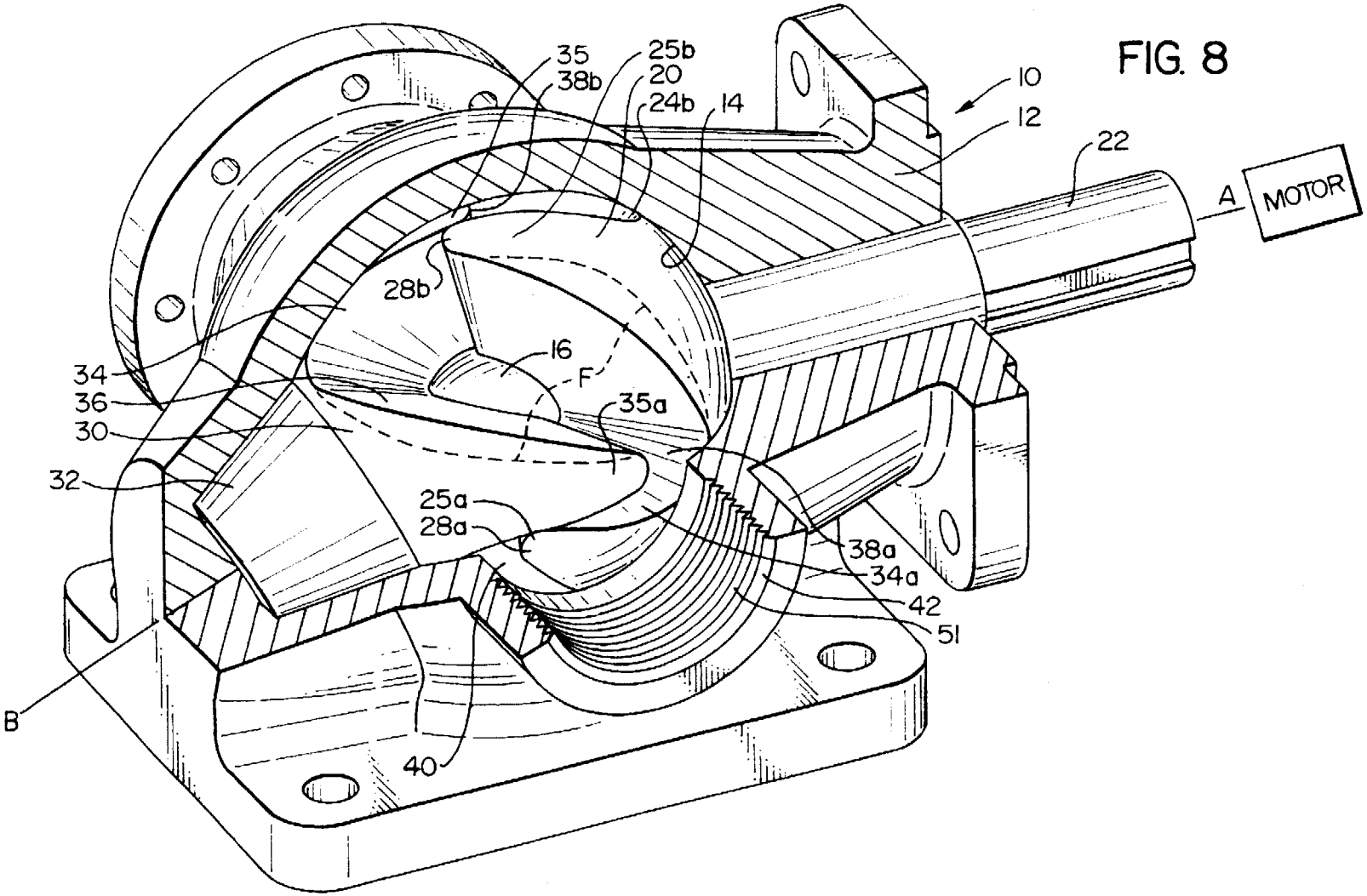
FIG. 8 shows an isometric view of a master rotor and slave rotor housed within a ported housing according to the invention.
Figure 9:
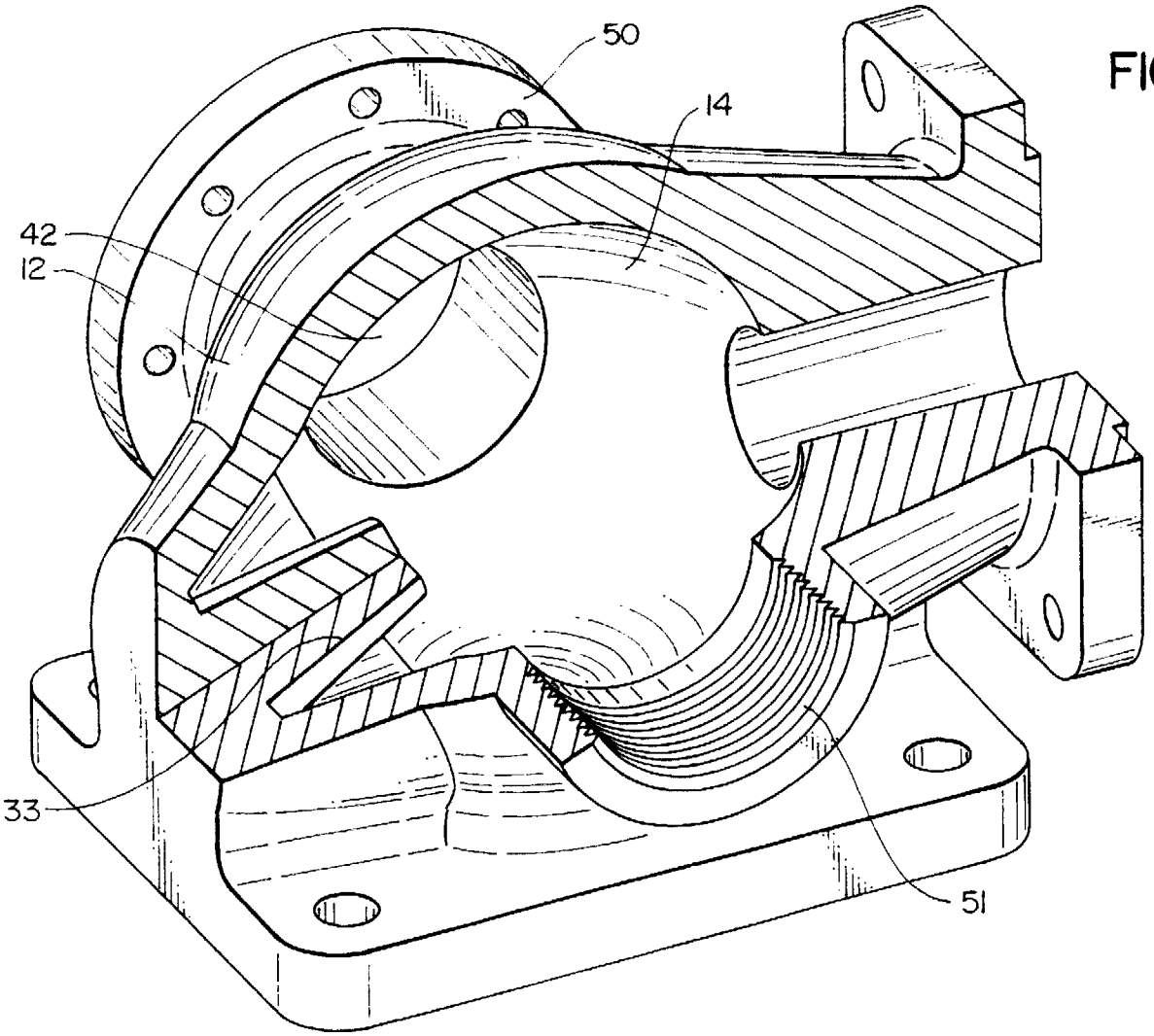
FIG. 9 is a schematic showing the interior of the housing of FIG. 8.
Figure 10:
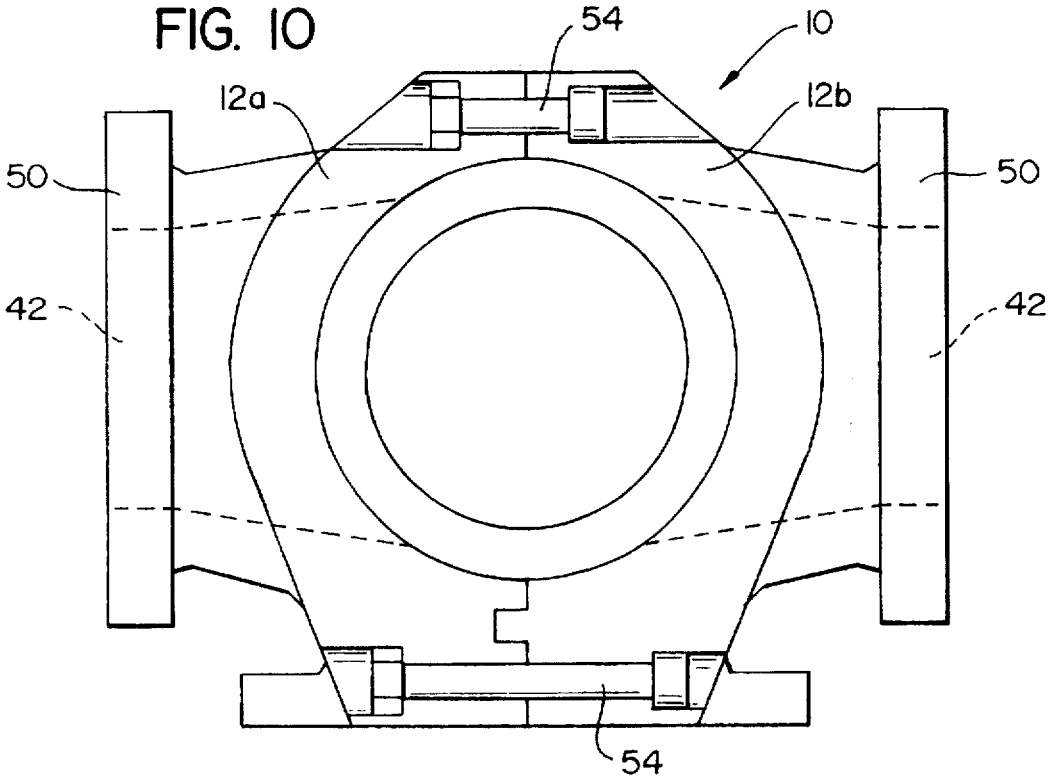
FIG. 10 is an end view, partially in section, of the housing of FIG. 8.

For the best understanding of the use of terms in this patent document, FIG. 8 should be reviewed in conjunction with FIG. 7A. In FIG. 8 there is shown an engine 10 formed by a housing 12 having an interior surface 14 defining at least a partially spherical cavity, with a central point at the center of bearing 16. A master rotor 20 is mounted for rotation on and within the housing 12 about a first axis A. The master rotor 20 includes a shaft 22 extending along the axis A and has contoured faces 24, 26 forming plural vanes 25 on the other side of the master rotor 20 from the shaft 22. A slave rotor 30 is mounted for rotation on and within the housing 12 about a second axis B. The slave rotor 30 includes a shaft 32 and has contoured faces 34, 36 forming plural vanes 35*a* on the other side of the slave rotor 30 from the shaft 32. Each of the rotors 20, 30 defines at least part of a sphere, and shares a common center coinciding with the center of the cavity. The vanes 25, 35 of the opposed faces of the rotors 20, 30 interlock with each other to define chambers. Axis A and axis B are non-collinear, being at an angle a to each other, and intersect at the center of the cavity defined by the housing. The shaft 32 is journalled on an axle 33 (FIG. 9) in this example (configuration as a pump, turbine or hydraulic engine) since the slave rotor 30 need not be driven. The shaft 32 may also be cantilevered in the same manner as the shaft 22. The master rotor 20 and slave rotor 30 face each other within the housing in an axial direction, each being predominantly on one side of the common center of the rotors.

The portion of the interior surface 14 that is spherical is the portion in which both the vanes of the master rotor 20 and slave rotor 30 rotate. In an extreme position, where the vanes of one rotor extend into the shaft of the other rotor (as for example shown in FIGS. 11B and 11C) the vanes of both rotors extend into the shafts 22, 32. The shafts 22, 32 are not spherical, but rotationally symmetric. In addition, the master rotor 20 and slave rotor 30 should be generally spherical in the portions in which they overlap during operation. The remainder of the rotors 20, 30 and the interior surface 14 need only have rotational symmetry to the extent required to have the rotors 20, 30 rotate in the housing 12.

As will be seen, the contoured faces 24, 26, 34, 36 of the master rotor 20 and slave rotor 30 cooperate with each other and the interior surface 14 of the housing 12 to form chambers 40 (the space between the faces of the rotors) that change volume with rotation of the rotors 20, 30 about the axes A and B respectively. Ports 42 are provided in the housing 12 to allow fluid flow in and out of the chambers.

Each contoured face is formed of a contact face 24, 34 and a side face 26, 36 defining vanes (blades) 25, 35 between them. The contact faces 24, 34 form areas of contact between the two rotors 20, 30. Sealing of the chambers 40 is accomplished by close tolerance fit of the rotors 20, 30 against the housing 12 and bearing 16, as well as contact of the vanes 25, 35 with respective contact faces 24, 34.

The structure of the engine is perhaps best understood by reference to the manner of construction of the rotors 20, 30.

Figure 1A:
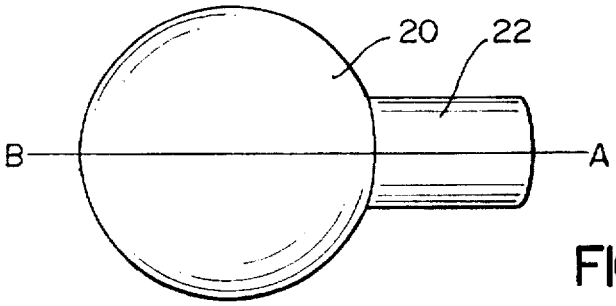
FIG. 1A is a top view of a spherical master rotor on axial shaft lying on axis A at an angle $\alpha$ to axis B prior to modification of the rotor in accordance with the principles of the invention.
Figure 1B:
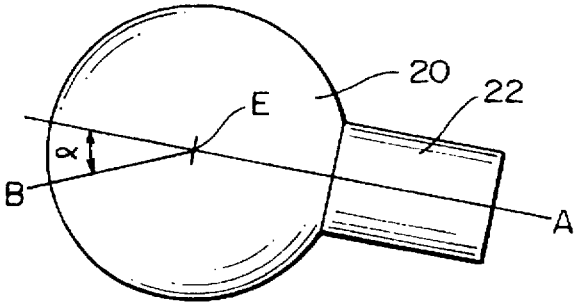
FIGS. 1B and 1C are a side view and isometric view respectively of the master rotor of FIG. 1A.
Figure 1C:
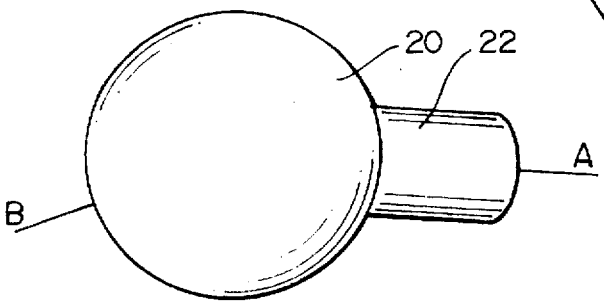

Referring to FIGS. 1A, 1B and 1C, a master rotor 20 is shown for example in an initial stage of construction. The slave rotor 30 of FIG. 8 is similarly constructed. The master rotor 20 begins as a sphere with a shaft 22 lying along an axis A. Axis B is shown at an angle $\alpha$ to the axis A.

Figure 2A:
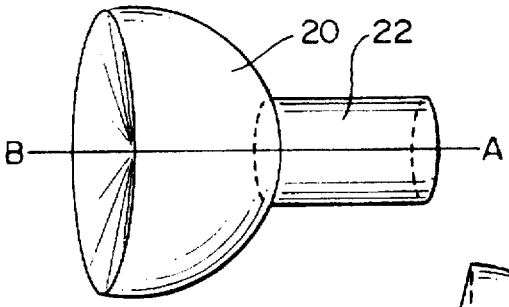
FIG. 2A is a top view of a master rotor having material removed from the side of the rotor opposed to the axial shaft leaving a conical face with the apex of the cone at the center of the sphere with its axis aligned with the axis A, the cone having apical angle $180-\alpha$.
Figure 2B:
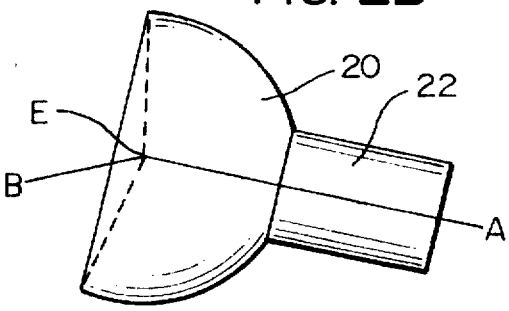
FIGS. 2B and 2C are a side view and isometric view respectively of the master rotor of FIG. 2A.
Figure 2C:
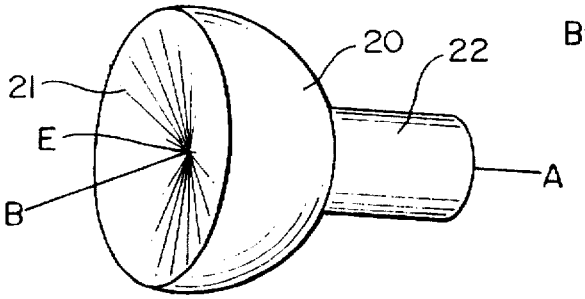

Referring to FIGS. 2A, 2B and 2C, material is removed from the master rotor 20 to leave a conical section 21 whose apex is at the center E of the spherical master rotor 20, and whose apical angle is 180–α°. The axis of the cone lies along the axis A.

Figure 3A:
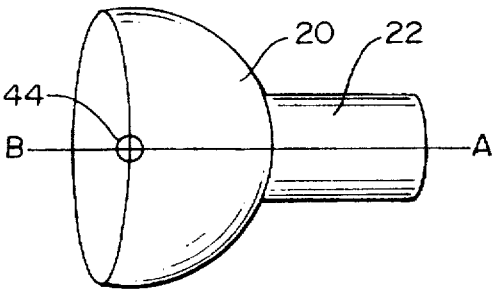
FIG. 3A is a top view of the master rotor of FIG. 2A with a vertically oriented cone of material conceptually overlaid on the front face of the master rotor, the cone having its apex at the intersection of axis A and axis B (same as the center of the master rotor sphere)
Figure 3B:
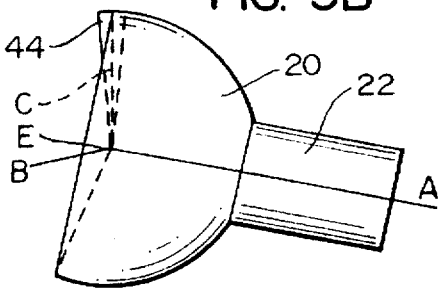
FIGS. 3B and 3C are a side view and isometric view respectively of the master rotor of FIG. 3A.
Figure 3C:
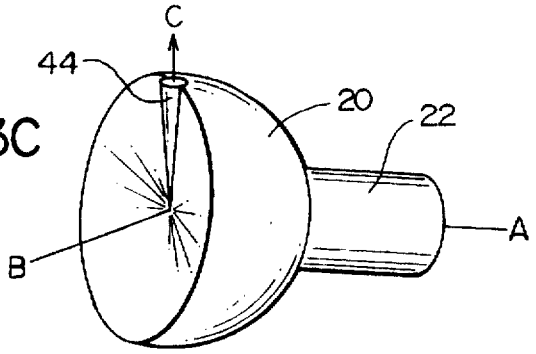

Referring to FIGS. 3A, 3B and 3C, a conceptual cone 44 is overlaid on the master rotor 20. This conceptual cone 44 may be thought of as part of the slave rotor 30, as if the conceptual cone 44 were lying on the equivalent part of the slave rotor 30 when the slave rotor 30 has its center located at the center of the master rotor 20 (both at center E of the spherical housing). As shown in FIG. 8, the conceptual cone 44 is the tip 38*a,b* of one of the vanes 35 of the slave rotor 30. The cone 44 has its apex at the center of the sphere of the master rotor 20, and its central axis C lies along the surface of the conical face of the master rotor 20, such that the central axis C is a radius extending outward from the center of the cavity at an angle α/2 from a normal to the axis of the other rotor. In effect the central axis C of the cone bisects the larger of the two angles formed by the axis A and the axis B in the plane in which both axes A and B lie. The cone 44 has an apical angle θ. The size of θ depends partially on the strength of the material of which the master rotor 20 and slave rotor 30 are made. The greater the angle θ, the lower the stresses on the tips of the vanes 25, 35, and the lower the pressure exerted by the vanes 25, 35 on the contact faces 24, 34. Values of θ depend on a to some extent. Large α near 45° requires small θ to avoid the vanes extending past the axis of rotation and to avoid removal of too much material, the material being needed to support the vanes. Smaller θ may have larger θ for like reason. α is preferably between 1° and 45°.

Figure 4A:
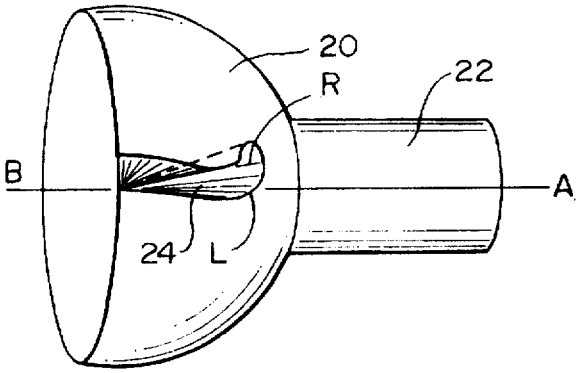
FIG. 4A is a top view of the master rotor of FIG. 3A showing the movement of the conceptual cone in the frame of reference of the master rotor as would be traced by the conceptual cone if it were attached to the front face of an essentially identical rotor (slave rotor) lying on axis B and having a center at the point of intersection of axis A and axis B and if the slave rotor was rotated through 180° with the master rotor from the vertical position (the conceptual cone is shown starting off center but it should be appreciated that the axis of the cone begins its movement at top dead center, corresponding to the point of lowest compression in the engine of this invention)
Figure 4B:
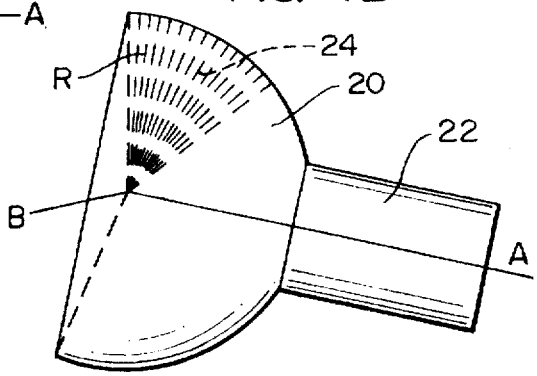
FIGS. 4B and 4C are a side view and isometric view respectively of the master rotor of FIG. 4A.
Figure 4C:
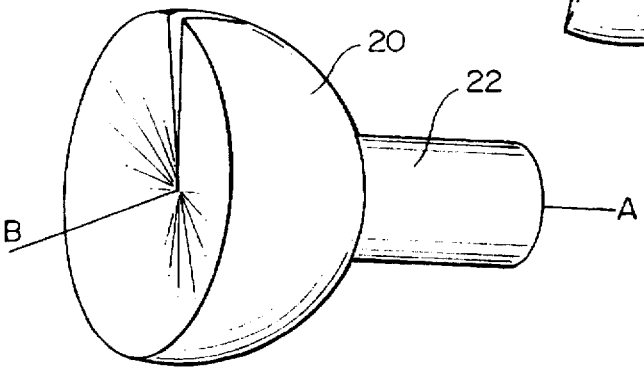
Figure 5B:
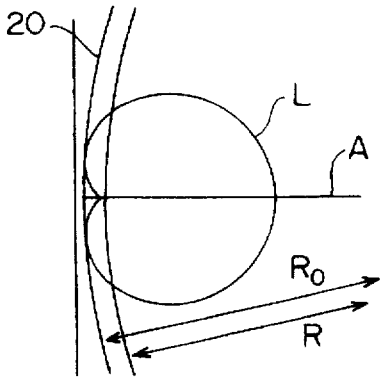
FIG. 5B shows the trace of FIG. 5A seen in the A axis direction.
Figure 5A:
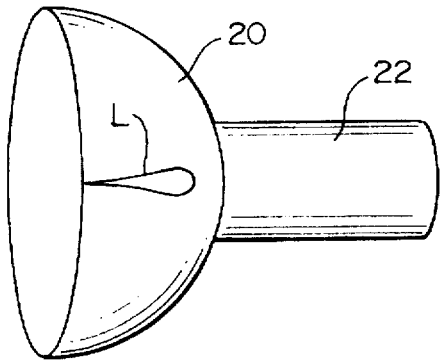
FIG. 5A shows the trace of the center of the conceptual cone of FIG. 3A on the surface of the master rotor while the slave rotor and master rotor make one revolution about their respective axes.

Referring to FIGS. 4A, 4B and 4C, to create a contact face 24, the conceptual cone 44 is rotated with the master rotor 20 as if the cone were on the slave rotor 30 lying on axis B with its center at the center of the master rotor 20. Both rotors 20, 30 rotate together on different axes. The path of the cone 44 is shown in FIG. 4A. The locus L of the center of the cone at the surface of the rotor 20 in the frame of reference of the master rotor 20 is shown in FIGS. 5A and 5B. FIG. 5A shows a top view. FIG. 5B shows a view along the axis A. It will be seen that the locus L is a tear drop shape. The actual shape removed by the cone 44 is defined approximately by adding a band θ/2 wide around the tear drop shape shown in FIG. 5. The tear drop is on the surface of a sphere so that angular distances are readily calculated.

A mathematical description of the locus L is as follows.

If $R_o$ is the radius of the sphere defining the master rotor 20, and φ is the rotational angle from the top, then the trace of a point (x,y,z) on the axis C in the frame of reference of the master rotor 20 is believed to be:

$$x=K_1 \cos\beta$$

$$y=-K_1 \sin\beta \cos\gamma$$

$$z=K_1 \sin\beta\cos\gamma$$

$$\text{where: } K_1 = R\sqrt{1+4\sin^2(\alpha/2)(1-\cos\phi)}$$

$$\cos\beta = (1+2\sin^2(\alpha/2)(1-\cos\phi)\cos\phi)R/K_1$$

$$\sin\beta = \sqrt{1-\cos^2\beta}$$

-continued $$\cos\gamma = \frac{K_2^2+K_3^2+-K_4^2}{2K_2^2K_3^2}$$

$$K_2 = R\cos\phi\tan\beta$$

$$K_3 = R\sin\phi$$

$$K_4 = (2R\sin\phi/2)^2 + \left(K_1 - \frac{R\cos\phi}{\cos\beta}\right)^2 - \left(K_1 - \frac{R\cos\phi}{\cos\beta}\right)\left[\frac{(2R\sin\phi/2)^2+K_1^2-R^2}{K_1}\right]$$

Rotation of the rotors about 180° around the axes A, B, with consequential movement of the cone 44 within the master rotor 20 is required to create the entire contact face 24. Rotation less than 180° by a small amount may be acceptable in some cases, although not preferred. Such a design may allow some fluid flow between the vanes at the bottom point of the rotation. This may avoid vibration due to rapid pressure changes in the chamber between the two contact faces at the bottom of the rotation. At this position, the contact faces lie adjacent one another. If one contact face is constructed by rotation less than 180° then the corresponding contact face on the other rotor could be constructed by rotation greater than 180°.

The cone could be rotated 360° during construction but as the surface so created prevents use of interlocking vanes, requiring subsequent removal of material from the master rotor 20, there is no need to do so. The contact faces 24, 34 of each rotor 20, 30 are defined in this manner. There may be 2, 3, 4 or more contact faces on each rotor.

Effectively, this manner of construction means that each contact face of one rotor 20, 30 is defined by the locus formed as the rotors 20, 30 rotate about their respective axes A, B by points on the other rotor lying along an outer edge of the cone.

Figure 25:
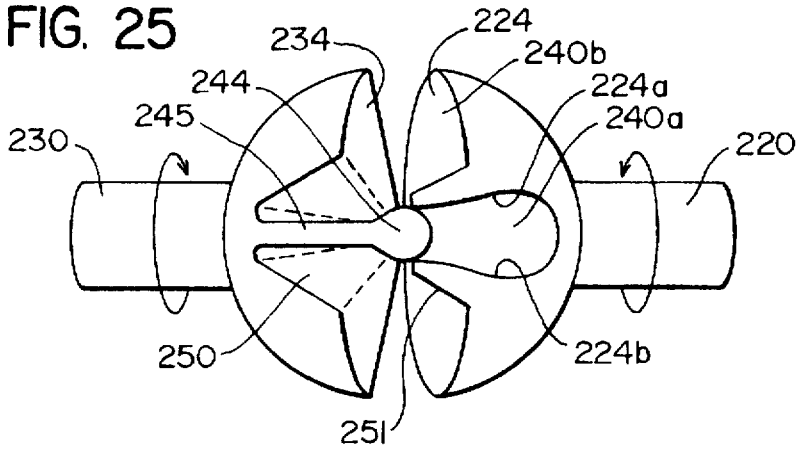
FIG. 25 shows a further embodiment of an engine according to the invention in which the vanes of one rotor are in continuous contact with the vanes of the other rotor.

Since the contact faces 24, 34 of one rotor are defined by the movement of points on the other rotor as the two rotors rotate with each other, it can be guaranteed that there will be points of contact between the two rotors along a radial line R lying along a contact face through at least 180° of motion. The lines R shading the contact face 24 in FIGS. 4A, 4B, 4C, 6A, 6B and 6C illustrate the radial lines which define the instantaneous points of contact as the rotors rotate relative to each other. As the line defining the points of contact between the rotors reaches its furthest penetration into the rotor, continuation of contact on that contact face will mean that the contact face will wrap back on itself as shown in FIG. 5A. This would allow no part of the slave rotor 30 to penetrate the tear drop shape, unless the opposed faces of the tear drop cavity swept out by the conceptual cone maintained a sufficient separation to allow penetration by a vane of the slave rotor, such as is shown in FIG. 25, that is not symmetrical with the vane of the master rotor. Therefore, in the case where the vanes are to be symmetrical, it is necessary for the point of contact between the rotors to switch to a corresponding contact face on the other rotor. It so happens that when each rotor is a mirror image of the other, and contact faces are defined as illustrated in FIGS. 4A, 4B and 4C, then the line of contact switches from the contact face 24 of one rotor to a contact face of the other rotor. This switch occurs at the bottom of the housing and at the top of the housing, namely when the contact faces straddle the line bisecting the acute angle between the axes A and B. The switch from one contact face 24*a* to the other contact face 34*a* can be understood from inspection of FIG. 8. Tip 28*a* of vane 25*a* abuts contact face 34*a* as shown in the figure, and this will be the case throughout the time the vane 25*a* is on the side of the engine shown in the figure and for a short distance after bottom dead centre. After the vane 25*a* passes the top position illustrated by vane 25*b* in the figure, tip 38*a* of vane 35*a* will abut contact face 24*a* of the master rotor in much the same manner as vane 25*a* abuts contact face 34*a* as shown. By construction of all contact faces 24, 34 in the manner described, continuous contact between vanes 25, 35 on opposed rotors may be guaranteed. Use of a cone for shaping one rotor, thereby removing material, however, will leave a gap between the rotors unless material is added to the other rotor.

Figure 6A:
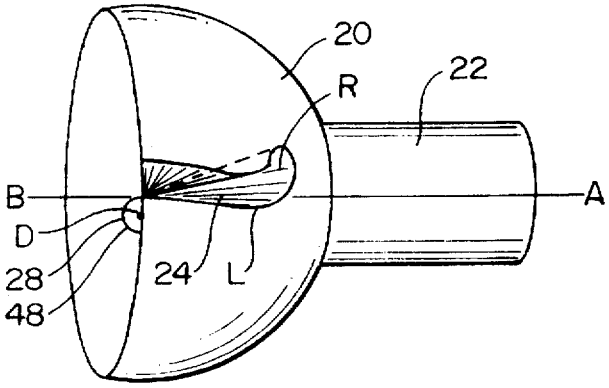
FIG. 6A is a top view of the master rotor of FIG. 4A showing an actual cone of material added to the front face of the master rotor, the cone having its apex at the intersection of axis A and axis B, with the axis of the cone lying along the face of the master rotor whose surface is tangential to a contact face of the master rotor.
Figure 6B:
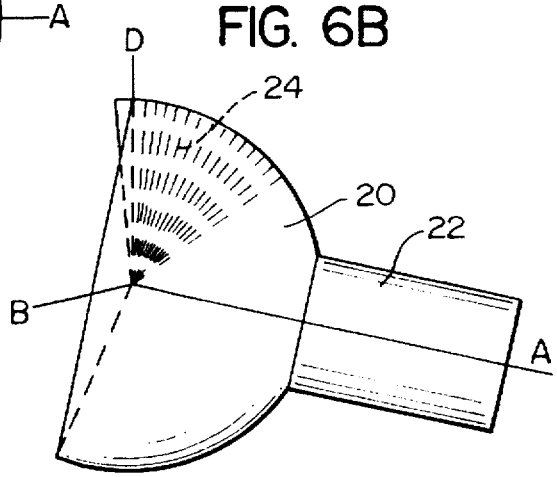
FIGS. 6B and 6C are a side view and isometric view respectively of the master rotor of FIG. 6A.
Figure 6C:
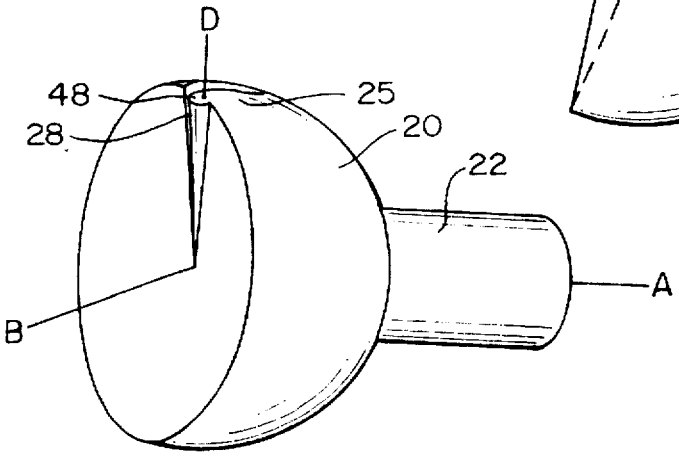

FIGS. 6A, 6B and 6C, show how gaps between the rotors at the vane contacts are avoided. A cone of material 48 corresponding exactly to the conceptual cone of material 44 is added to the rotor. In these figures, the cone of material 48 is shown on the master rotor 20. Rotation of this cone of material 48 on the master rotor 20 while the slave rotor 30 rotates with the master rotor will create a contact face 34 on the slave rotor 30 in the same manner as the contact face 24 was created on the master rotor 20. The contact face 34 will have the same tear drop shape as shown in FIGS. 5A and 5B. In order for the correct tear drop shape to be made, the starting point for the removal of material from the rotor must be when the axis D of the cone of material 48 lies at the top, namely along the line bisecting the obtuse angle between the axes A and B. Thus, as shown in FIG. 6A, the cone 48 must be rotated by half of its apical angle before it can be used to remove material from the slave rotor 30. This cone of material 48 defines the tip 28 of a vane 25 on the master rotor 20. The extra amount of material on the tip 28 created by the cone of material 48 compensates for the loss of material during construction of the master rotors contoured faces by using the conceptual cone 44. It will be noted that the cone of material 48 and 44 need not be exactly conical, nor must the apex of the cone be exactly at the center of the cavity, but contact portions between the vanes 25 of the master rotor 20 and contact faces 34 on the slave rotor 30 should have a smooth surface. The closer the apex to the center of the cavity, the better for the operation of the rotor. The term essentially as used in the claims is intended to cover an engine whose cone 48 is not exactly defined in the manner stated, but that embodies the concept of the invention.

Figure 7B:
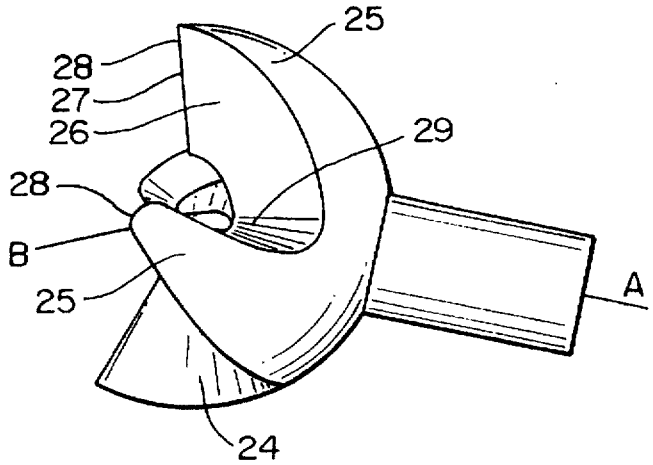
FIGS. 7B and 7C are a side view and isometric view respectively of the master rotor of FIG. 7A.
Figure 7C:
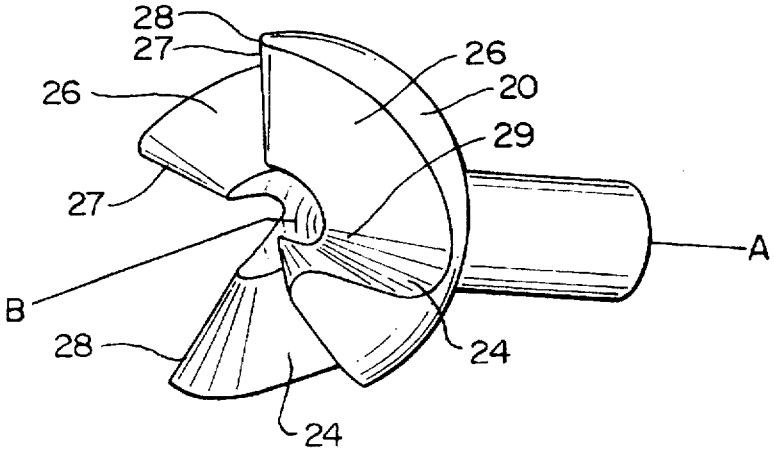

Referring to FIGS. 7A, 7B and 7C, a master rotor 20 is shown with four vanes 25 and four contact faces 24 made as described above. Side faces 26 connect inner ends 27 of one contact face 24 with the outer ends 29 of adjacent contact faces. The side faces 26, unlike the contact faces 24, have a somewhat arbitrary shape. Clearly, they should not stick out beyond the tips 28 of the vanes 25, else they will crash into the side faces 36 of the slave rotor 30. The shape of the side faces 26 can be adjusted for different volumetric ratio changes of the chambers 40 defined between the rotors 20, 30. The chambers 40 may compress to one seventh their maximum size (compression ratio 7:1) in a three vane case. For the embodiment shown by the dotted line in FIG. 8 the ratio will be smaller. For any one chamber, the point of maximum compression occurs when the vanes 25*a*, 35*a* are equidistant from the bottom of their rotation, that is from the line bisecting the acute angle between axes A and B. Enlargement of the chambers 40 may be accomplished by removing material from the side faces 26, 36 to render them concave. Dotted lines F in FIG. 8 show preferred cutting lines. The resulting chambers have considerable volume for the efficient pumping of fluid due to reduction in fluid velocity at the intake and exhaust chambers.

The master rotor 20 and slave rotor 30 could conceivably rotate cantilevered on their shafts 22, 32 respectively without additional bearings. However, contact problems and fluid loss at the center of the cavity poses considerable difficulties. It is preferred that a spherical bearing housing be formed by removal of a partial sphere of material from the center of each of the master rotor 20 and slave rotor 30 as shown in FIGS. 7A, 7B and 7C. The spherical bearing housing houses bearing 16.

The material of the rotors housing the bearing 16 as shown in FIGS. 7A, 7B and 7C is in fact concave over greater than 180°, creating difficulties in construction. The bearing may be made integral with or otherwise fixed to either rotor, preferably the master rotor 20. For the other rotor, the bearing 16 can be loosely fitted in a less than 180° bearing housing, resulting in a greater leakage path, or the bearing may be press fitted into the housing, thermally contracted and inserted into the bearing housing, or slotted for insertion and rotated once inside the bearing housing to present a round bearing surface to the slave rotor.

The complete engine is shown in FIG. 8. Master rotor 20 is driven by a power source 41 through shaft 22. Vanes 25 of rotor 20 push on contact faces 34 of rotor 30 on the side shown and on the other side (not shown) contact faces 24 of rotor 20 push on vanes 35 of rotor 30. The pump may be made to pump in reverse by reversing the position of the contact face and side faces of one or more of the vanes of one rotor and the contact faces and side faces of corresponding vanes on the other rotor. That is, where the side face is presently on a vane as shown in the figure would become the position of a contact face and vice versa.

Figure 12:
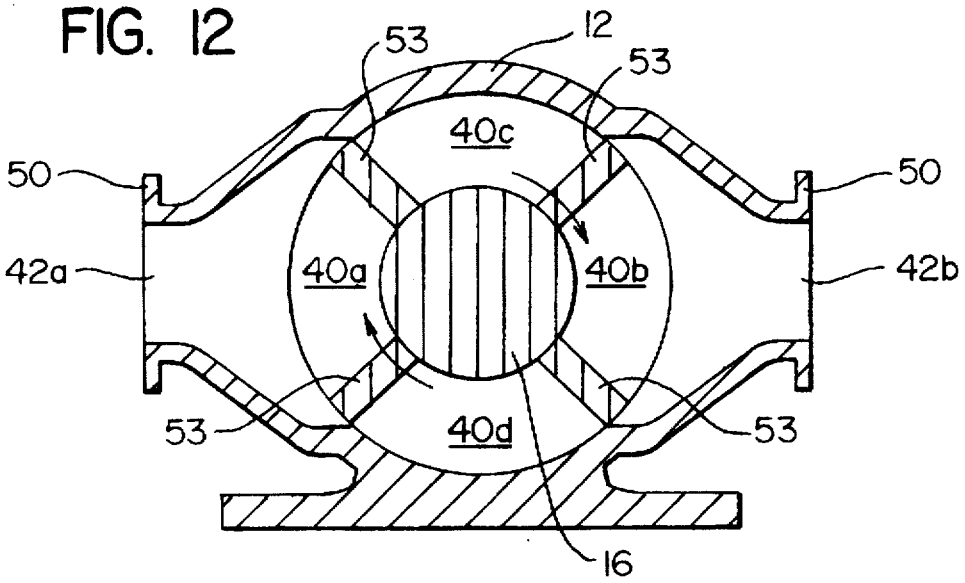
FIG. 12 is a schematic section through a stylized four vaned pump according to the invention, the section being taken along a plane bisecting the axes of the rotors, to illustrate port placement.
Figure 14:
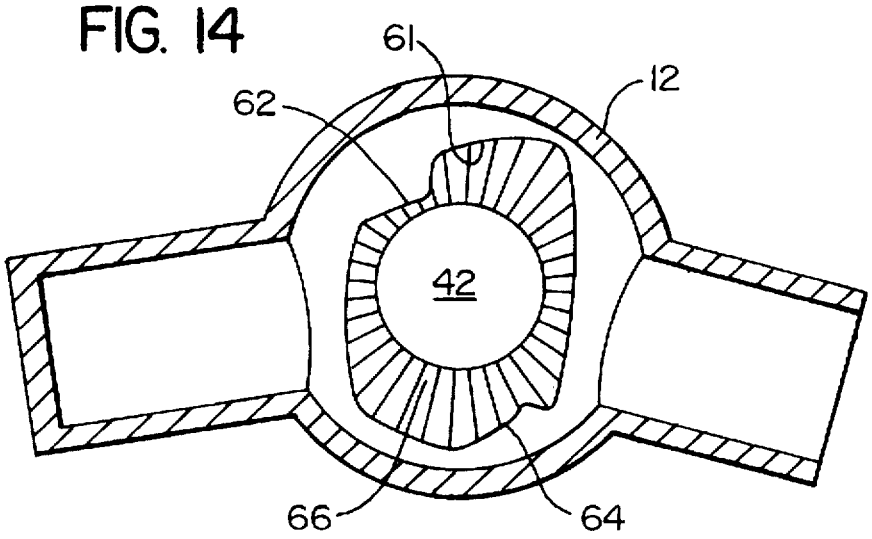
FIG. 14 shows a stylized housing for a pump according to the invention with a preferred configuration of a port for use with the embodiment of FIG. 8.

The internal and external configuration of the housing is shown in FIGS. 9, 10, 11A and 12. In particular, the location of the ports 42 can be clearly seen in FIG. 9, 10 and 12 along with flanges 50 for connection of the housing 12 to input and output pipes (not shown). An alternative threaded coupling 51 is also shown in FIG. 8. The housing 12 is preferably formed of two halves 12*a* and 12*b* bolted together with bolts 54. The ports 42 are located at opposed sides of the housing, with an intake port 42*a* and outlet port 42*b*. FIG. 12 shows a four vaned pump with two ports 42. Areas 53 show contact areas of vane on contact faces between the master and slave rotors 20, 30. Fluid enters the intake port 42*a* and expanding chamber 40*a*. Chamber 40*c* is at maximum expansion in this rotational position. Chamber 40*b* is contracting and therefore forces fluid out of port 42*b*. Chamber 40*d* is at maximum compression in this rotational position. Preferably, the ports 42 have peripheries that match the chamber configurations at the point the chambers cross the boundaries of the ports so that as many points as possible of the chamber edge, defined by a pair of vanes 24, 34, cross the port edges at the same time. An exemplary port shape with peripheral edge 61 and port passage 66 is shown in FIG. 14, with advancing side 62 and retreating side 64. The trailing edge of the set of vanes beginning to cross the exhaust port or intake port defines the preferred shape of the port at that position. The leading edge of the vanes exiting the intake port or exhaust port defines the preferred shape of the port at that position.

Figure 11A:
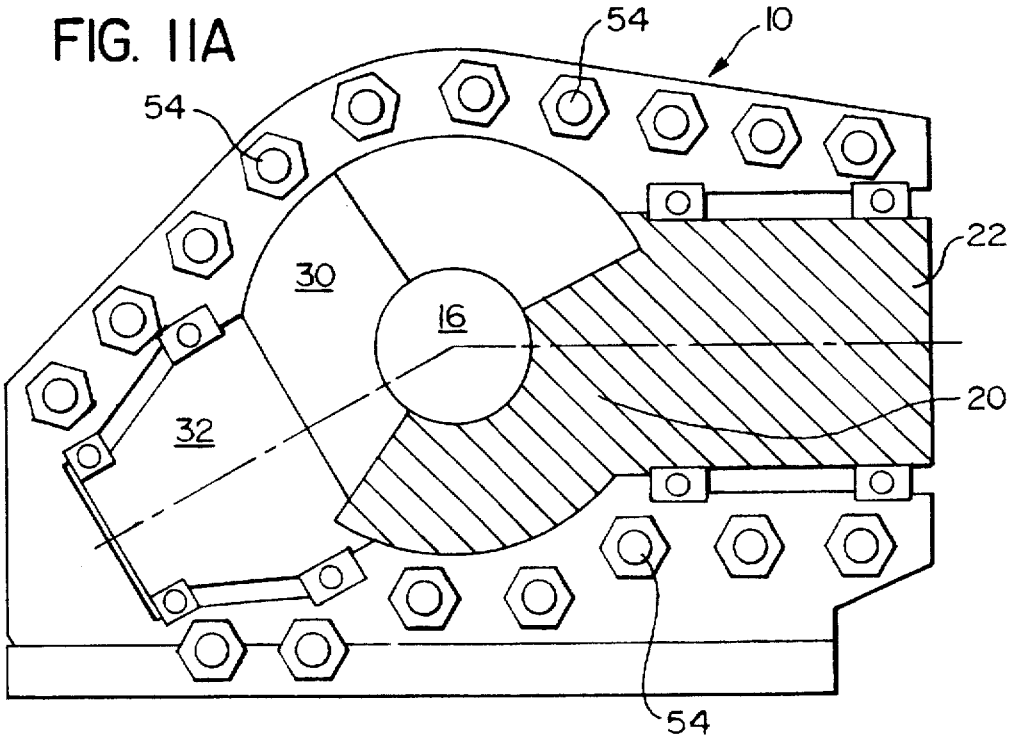
FIG. 11A is a schematic, partially in section, of the housing of FIG. 8 showing a cantilevered slave rotor shaft.
Figure 11B:
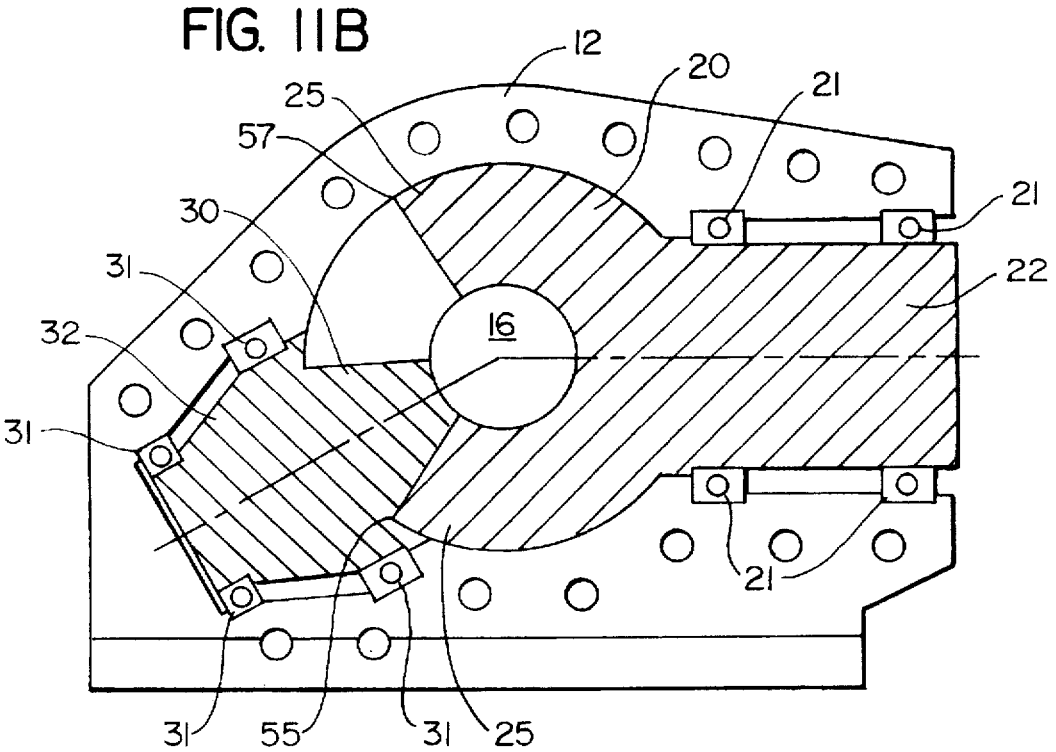
FIG. 11B shows a further embodiment of an engine according to the invention, in section, with vanes of each rotor extending into the shaft of the other rotor.
Figure 11C:
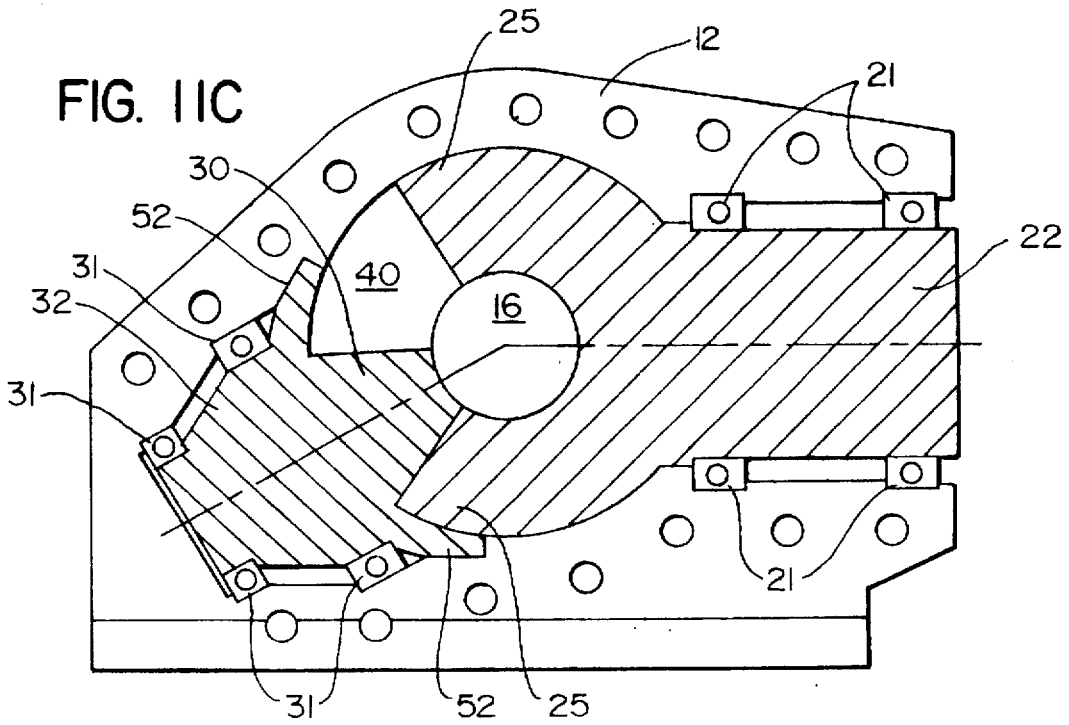
FIG. 11C is a section showing the embodiment of FIG. 11B with part of the shaft of the slave rotor extending around the master rotor.

FIGS. 11B and 11C illustrate an embodiment of the invention in which the vanes of each rotor extend into the shaft of the other rotor. Shown in FIG. 11B and C, is master rotor 20 with shaft 22 mounted on bearings 21 in housing 12 and slave rotor 30 with shaft 32 mounted on bearings 31. The vanes 25 of master rotor 20 extend into the shaft 32 of rotor 30 as shown at 55 at the bottom position. It will be noted that the vanes 25 do not extend into the shaft 32 at the top position 57. FIG. 11C shows a similar embodiment to FIG. 11B except that the shafts 32 have been extended at 52 to partially surround the vanes 25 of master rotor 20 and to define part of the boundaries of the chambers 40, particularly in the top position.

The chambers 40 therefore need not be defined by the faces 24, 26, 34 and 36 and bearing alone, but may also be defined in part by a portion of the shafts of the rotors extending around the rotors. Both shafts 22 and 32 may extend in this manner (for example at 52 in FIG. 11C), but they cannot extend so far that the extensions of both shafts overlap at the bottom of the rotation. Thus, at least a V-shaped sliver of the housing with apical angle a and centered between the rotors 20, 30 is required in this instance to define the chambers.

Figure 13:
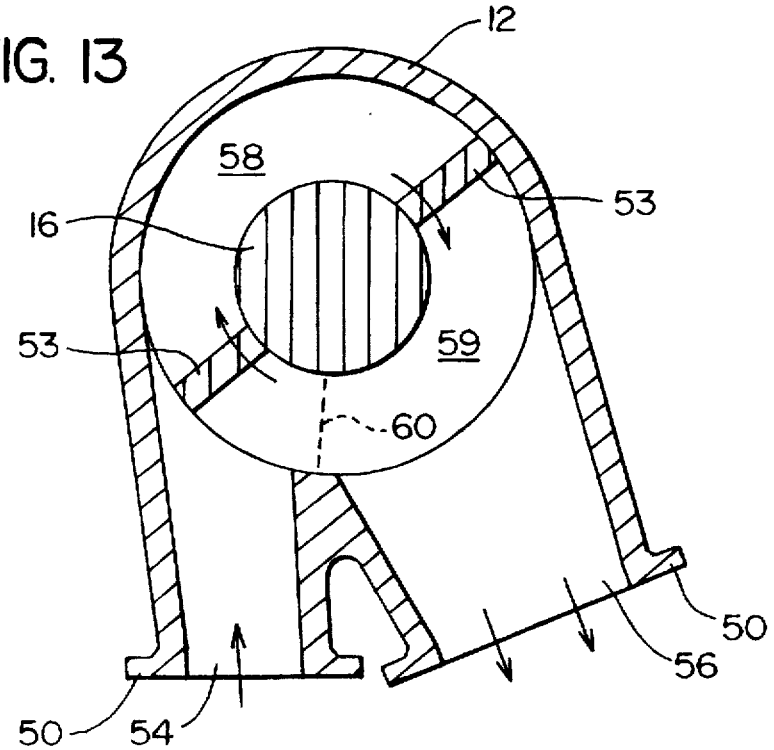
FIG. 13 is a schematic section through a stylized two vaned pump, the section being taken along a plane bisecting the axes of the rotors, also to illustrate port placement.

FIG. 13 shows an embodiment of the invention configured as a liquid or gas turbine. A two vane motor is possible as shown. Port 54 is a high pressure intake port and port 56 is a low pressure exhaust port. Gas expands in chamber 58 and exhausts from chamber 59. A close tolerance seal, such as a moving labyrinth seal or non contact gear interface, would be important at the dashed line 60 between the faces of the rotors.

Figure 15:
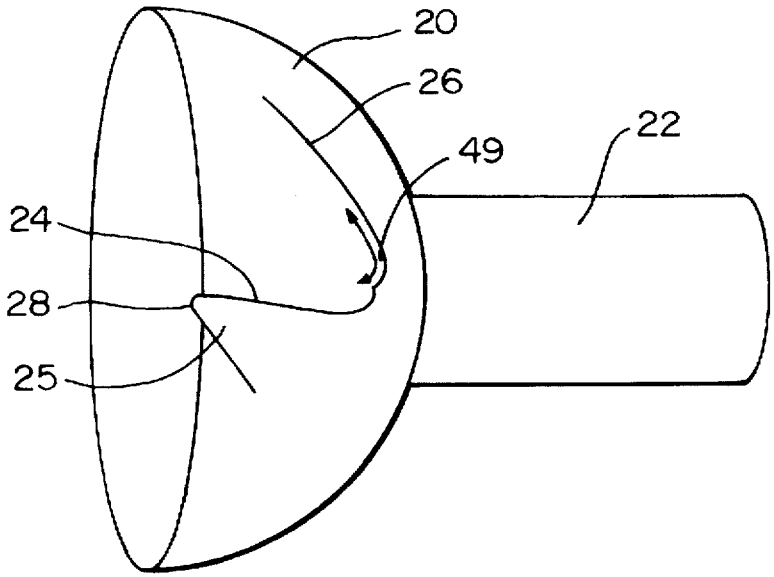
FIG. 15 is a schematic showing a side face with indentation.

A small void or indentation 49 in the side faces 26, 36, shown in FIG. 15, a quarter cone for example, may be subtracted from inner ends 27 of contact faces 24 to allow escape of fluid (shown by the arrows in FIG. 15) past the tips of the vanes 25, 35 at the point when the contact faces of master rotor and slave rotor lie along side each other. The indentation need not extend radially across the entire side face, but need only occupy a small portion, rather like a bleed hole. In this position, a small secondary chamber is formed between the contact faces of master and slave rotor at the bottom of the rotation. Provision of the small void 49 reduces fluid velocity due to squeezing of the fluid past the tips of the vanes from one chamber to another, thus preventing undue wear on the tips of the vanes and affecting an increase in efficiency.

For operation as a pump, the master rotor is driven by a power source. Rotation of the master and slave rotors with each other causes the chambers 40 to contract while moving from the point of maximum separation of the rotors at the top to the point of minimum separation of the rotors at the bottom. On the other side, the chambers expand. While expanding, the chambers intake fluid, and while contracting the chambers expel fluid, increasing the velocity and/or pressure of the fluid, and increasing the energy of the fluid. Thus, energy of the motor driving the pump is converted to energy imparted to the fluid.

The parts described here may be made of any suitable materials including plastics and metal, depending on the intended use. Steel may be used for the master rotor 20, while brass may be used for the slave rotor 30. At 10,000 rpm, a steel and bronze pump is believed to be able to produce 10 hp per lb weight of pump, and 20 hp per lb weight of pump for titanium rotors. Care must be taken to provide close tolerance fits of the vanes so that little fluid can escape past the vane contacts and between the rotor and the casing. Material may also be added to the vanes to allow wear.

This invention provides a positive displacement rotary pump with high efficiency, believed to be over 90% overall efficiency, and for a pump with eight inches outside diameter, with seven inch diameter rotors, is believed to be able to pump one liter per revolution. 100% rotary motion provides low stress on parts and low vibration. Applications include irrigation, fire fighting, down-hole water and oil pumping, hydraulics, product transfer pumps and high rise building water pumps.

Figure 16:
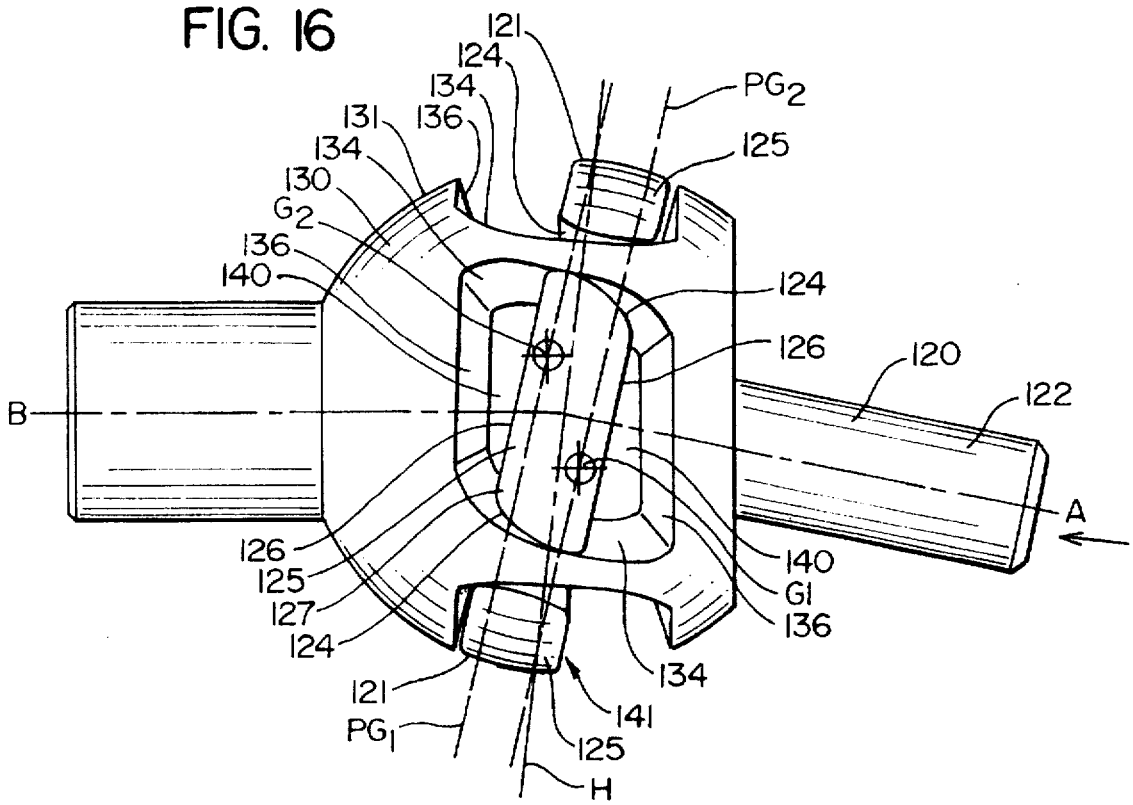
FIG. 16 is a schematic showing an embodiment of an external combustion engine with master rotor and slave rotor made in accordance with principles of the invention.

A further embodiment of the invention is shown in FIG. 16 for preferred operation as an external combustion engine. As with the pump embodiment of FIG. 8, the engine includes a master or power rotor 120 which rotates about a first axis A, and a passive rotor 130 which rotates about a second axis B offset from the axis A by an angle $\alpha$. Each rotor 120, 130 is partially spherical with a common center. This means that the exterior surfaces 121, 131 follow the interior of a sphere in areas in which parts of the rotors overlap so that both may rotate within the same spherical housing. Where the rotors do not overlap, the rotors need only have rotational symmetry. Each rotor includes contoured faces, including contact faces 124, 134 and side faces 126, 136. The contoured faces 124, 134, 126, 136 of the power and passive rotors 120 and 130 cooperate with each other to form chambers 140 that change volume with rotation of the master rotor and passive rotor about their respective axes.

Operational end 141 of power rotor 120 is surrounded by the passive rotor 130. The side faces 126 of power rotor 120 connect opposed (inner and outer) ends of contact faces 124 to define pistons 125. The side faces 136 of passive rotor 130 connect opposed (inner and outer) ends of contact faces 134 to define cylinders, one cylinder corresponding to each piston. Preferably, the pistons and cylinders in any one engine all have the same shape, so that description of one is description of all.

As with the pump, the contact faces 134 of the cylinders are defined by the locus formed as the rotors 120, 130 rotate about their respective axes by points on the contact faces 124 of the corresponding piston. Each contact face 124 of each piston 125 may be defined by a segment of a cone whose central axis $G_1$, $G_2$ is essentially a radius extending outward from the common center of the rotors. That is, the points on each contact face 124 lying at the same distance from the axis A lie on an arc centered on one of the axes $G_1$ and $G_2$. For any given piston, it is preferred that the two central axes $G_1$ and $G_2$ for any one piston lie on opposite sides of the plane H bisecting the axes A and B. In addition, it is preferred that the plane (marked $PG_2$) defined by rotation of the axis $G_2$ (the axis closest to the shaft 122 of the power rotor) intersect the plane H at bottom dead center (BDC) and the plane ($PG_1$) defined by rotation of the axis $G_1$ (the axis furthest from the shaft 122 of the power rotor) intersect the plane H at top dead center (TDC). The locations of $G_1$ and $G_2$ may be mirrored across the axis H. This only changes the orientation of the piston 125, not its function. The contact faces 124 of the pistons 125 need not be defined by radii from the common center of the rotors, but may be arbitrary in shape so long as the shapes of the corresponding faces 134, 136 of the cylinders 135 match the shape of the pistons 125, so as to provide a close tolerance seal between them for at least a portion of the rotation of the rotors 120, 130. The contact faces 124 need not be perfect arcs. Material at 127 may be removed along up to about one half of the contact face 124 to render the contact face 124 less arcuate, flat or even concave in this region. Such a design is believed to assist in squeezing fluid from the chamber 140 (compression side 140*a* in FIG. 17.1) as the chamber closes.

If arcuate contact faces 124 are centered on the same side of the plane H, then it is difficult to obtain a seal on both sides of the piston without the piston crashing into the cylinder walls at another rotor position. The orientation of the side faces 126, 136 is preferably perpendicular to the respective axes A and B at bottom dead center and top dead center. The side faces 126 are shaped to conform to the shape of the side faces 136, both in this preferred instance being flat, but other conforming shapes may be used. Conformity is required if a 100% compression ratio is required. The sides 126, 136 need not conform if less than 100% compression is acceptable. As with the sides 26, 36 of the pump of FIG. 8, the sides 126, 136 could be made concave.

Figure 17:
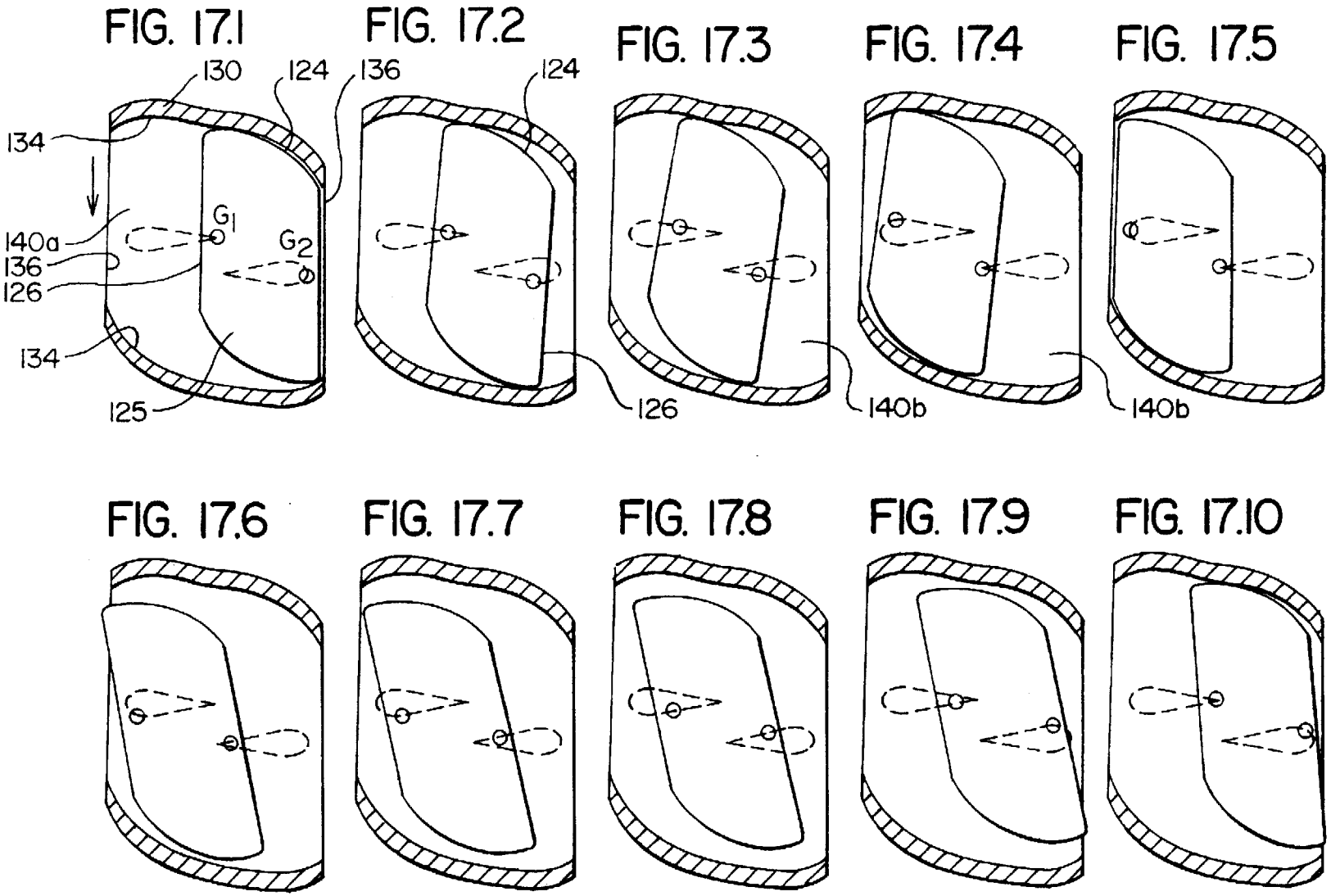
FIG. 17.1–17.10 are a series of schematics showing a top view of the motion of a piston and cylinder of the engine of FIG. 16 in the frame of reference of the slave rotor of FIG. 16.

The movement of the pistons 125 in the cylinders is shown by the sequence of views in FIGS. 17.1–17.10, which shows the movement of an exemplary piston 125 viewed from a rotating frame of reference that rotates with the rotors. The description that follows is for an external combustion engine, compressor, turbine or pump.

FIG. 17.1 shows the piston 125 at top dead center with one side 126 abutting one side 136 of the cylinder, essentially initiating expansion from zero volume of one side 140*b* of the chamber and compression on the other side 140*a* of the chamber to zero volume. At top dead center an intake port (not shown in FIGS. 17.1–17.10 but see FIG. 19) has just closed and an expansion port (not shown, but see FIG. 18) is about to open. In FIG. 17.2, the expansion port opens and expanding gas from the combustor 150 (FIG. 24) enters side 140*b* of the chamber defined by the cylinder. The expanding gas forces piston 125 across the chamber 140 causing both rotors to rotate about their axes. Contact faces 124 and 134 are in contact on both sides of the piston 125, thus sealing side 140*b* of the chamber. Arc centers on the piston 125 follow tear drop paths as shown, similar to the tear drop shape shown in FIG. 5A. The shapes in the figures are for the central axes $G_1$ and $G_2$. The tear drop shape for $G_1$ and arc centers on that side of the plane H is reversed from the tear drop shape for $G_2$ on the other side of the plane H, and the direction of movement around the tear drop is reversed, with the result that the piston 125 twists in the frame of reference of the cylinder as the rotors rotate. As expansion of gas in chamber 140*b* proceeds, gas is compressed in side 140*a*.

As expansion continues, the force of expansion may gradually decline while the compression in chamber 140*a* increases. As shown in FIG. 17.3, the expansion port first closes while expansion is still continuing and compression continues, with all ports closed. In FIG. 17.4, the compression port (FIG. 18) opens and compressed air is routed to combustor 150. At bottom dead center, chamber 140*a* is closed, and chamber 140*b* is at maximum volume. The compression port closes and the exhaust port (in chamber 140*b*) opens.

Throughout FIGS. 17.1–17.5, the piston is moving down from top dead center to bottom dead center (FIG. 18) and the piston is in continuous contact with the cylinder along both contact faces 124. In FIGS. 17.6–17.10, the piston is moving from bottom dead center to top dead center (FIG. 19), and the piston contact faces do not contact the contact faces 134 of the cylinder due to relative rotation of the piston to the slave rotor as the centers $G_1$ and $G_2$ follow the teardrop paths shown.

As the piston begins to work its way back across the cylinder as shown in FIG. 17.6, the intake port opens, allowing gas (for example, ambient air) into chamber 140*a* while exhaust continues in chamber 140*b*. In FIGS. 17.7–17.10, intake and exhaust continue, and just after the position shown in FIG. 10, both the exhaust and intake ports close, to complete the cycle.

Figure 18:
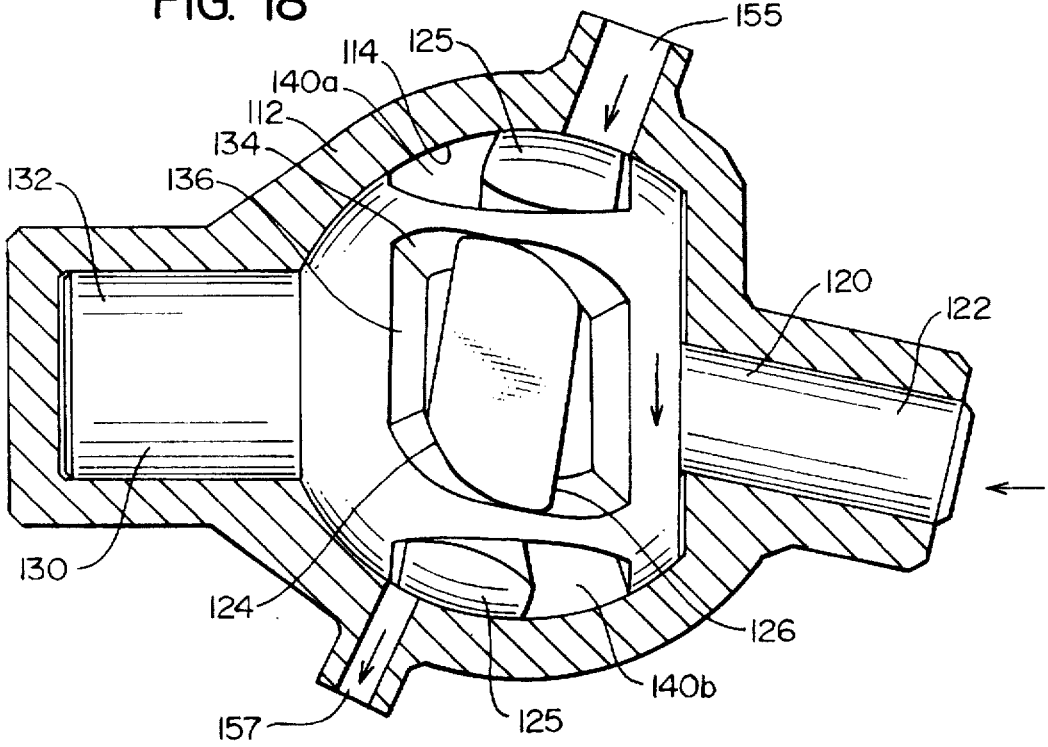
FIG. 18 is a side view, partly in section and partly cut-away, of the compression/expansion side of the engine of FIG. 16.
Figure 19:
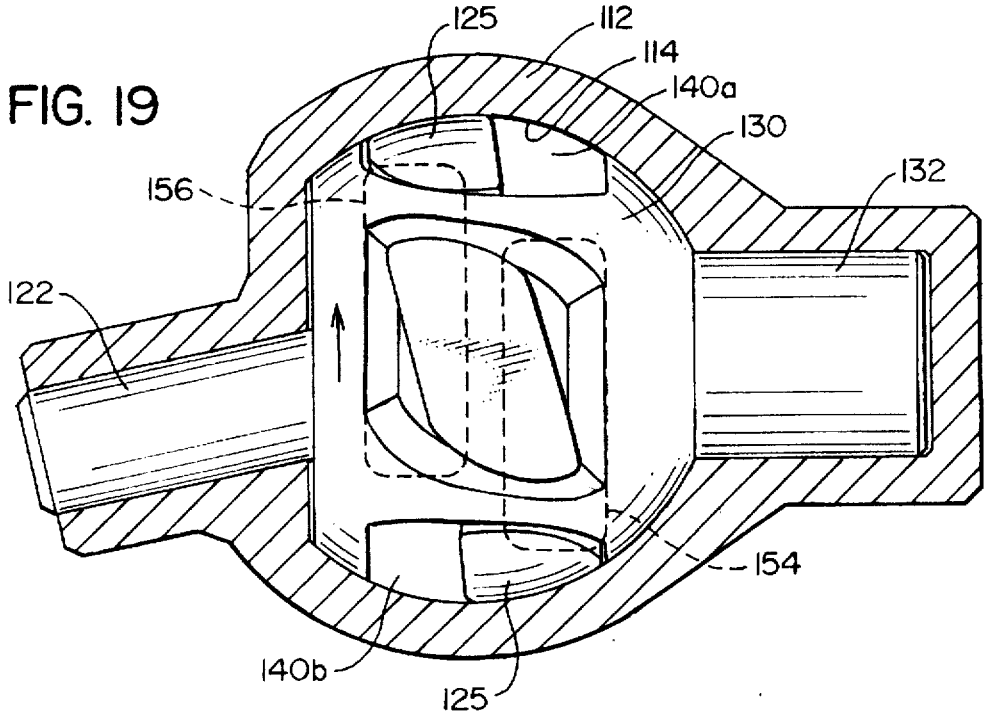
FIG. 19 is a side view, partly in section and partly cut-away, of the intake/exhaust side of the engine of FIG. 16.

As shown in FIG. 18, the rotors 120 and 130 are mounted in a housing 112, which has an interior surface 114 defining at least a partially spherical cavity, whose center coincides with the common center of the rotors 120 and 130. The housing interior surface 114 cooperates with the contoured faces 124, 126, 134 and 136 to form the chambers 140. In this instance the housing 112 surrounds both rotors. An expansion port 155 is formed in the housing 112 to allow expanding gases from combustor 150 (FIG. 24) to enter the chambers 140*b*. A compression port 157 is formed in the opposite side of the housing 112, and therefore on the opposite side of chambers 140 to allow compressed gas out of the chamber 140*a* and into combustor 150. FIG. 19 is a section taken from the other side of the engine of FIG. 18. The location of the intake port 154 and exhaust port 156 are shown. Both ports 154 and 156 are formed in the housing 112, although it is possible, as with the expansion and compression ports, to form them in the passive rotor itself.

Figure 20:
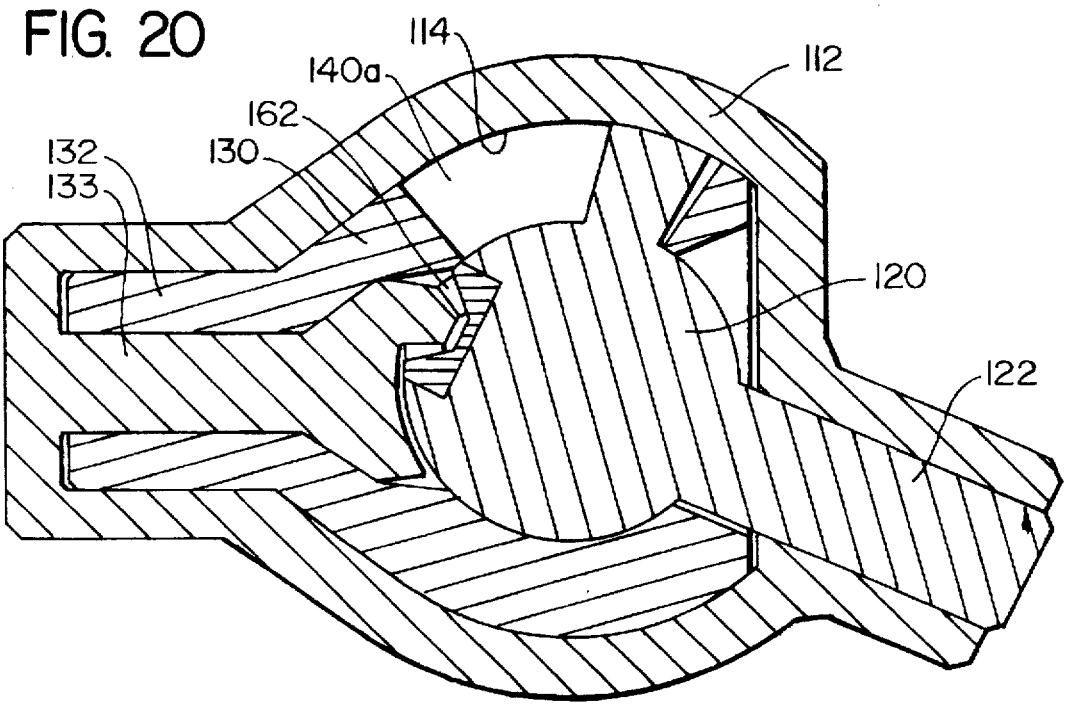
FIGS. 20–23 are axial sections of several embodiments of the engine of FIG. 16 showing a variety of shaft support systems and port locations.
Figure 21:
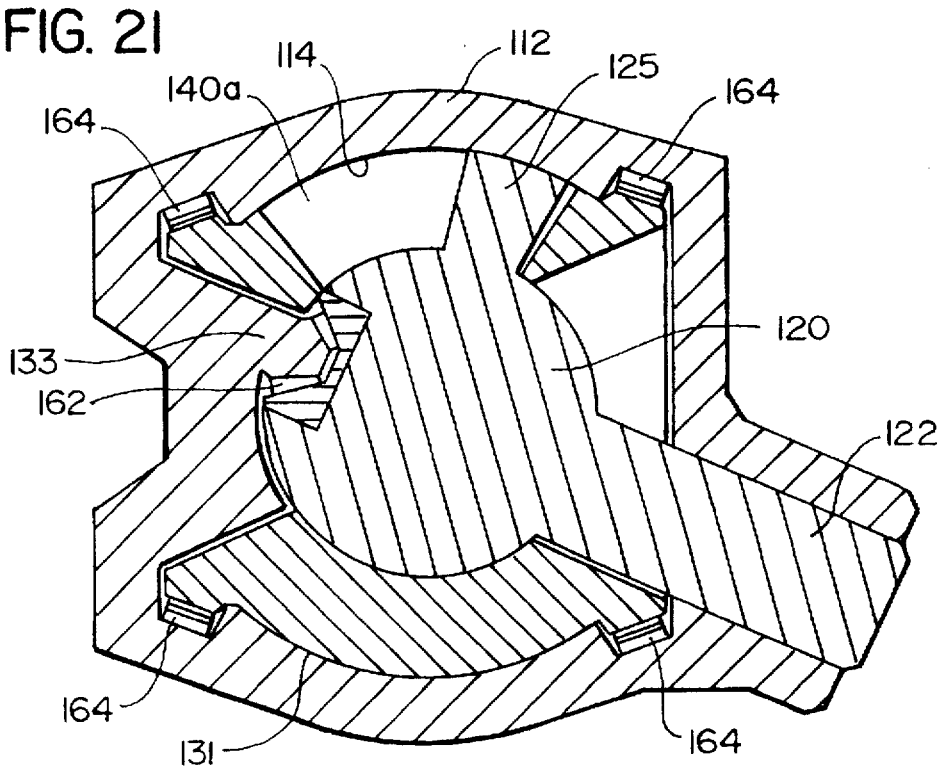
Figure 22:
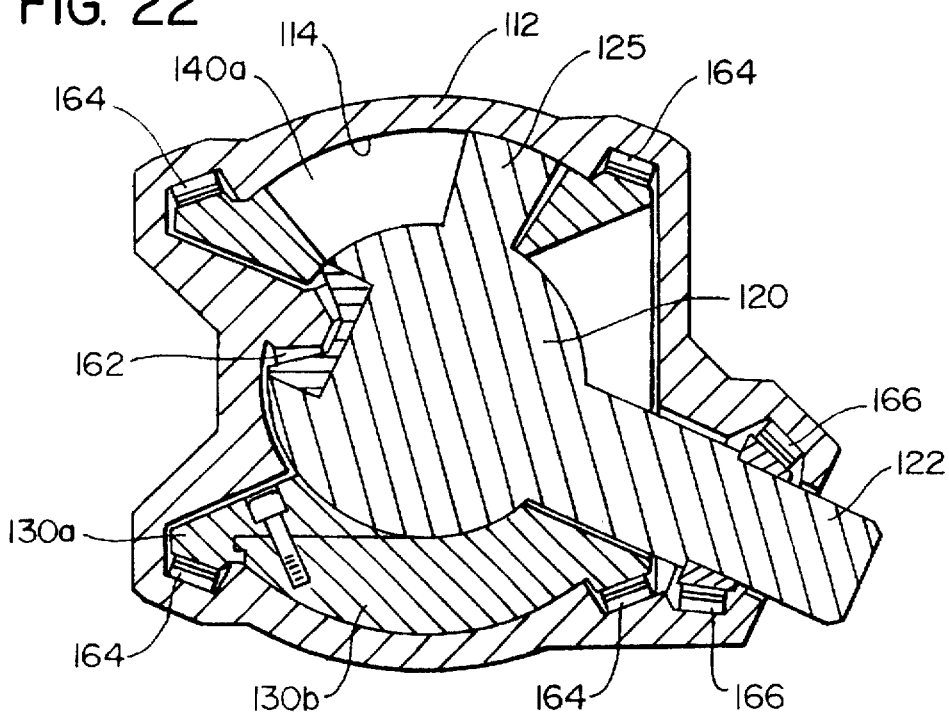
Figure 23:
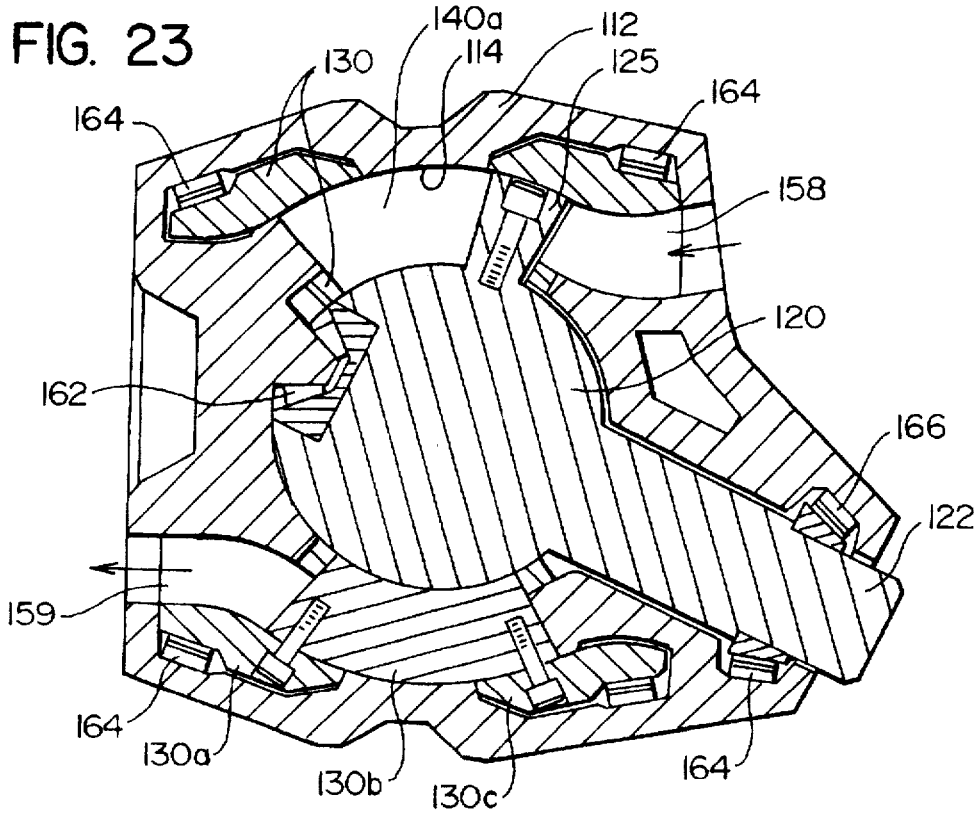
Figure 24:
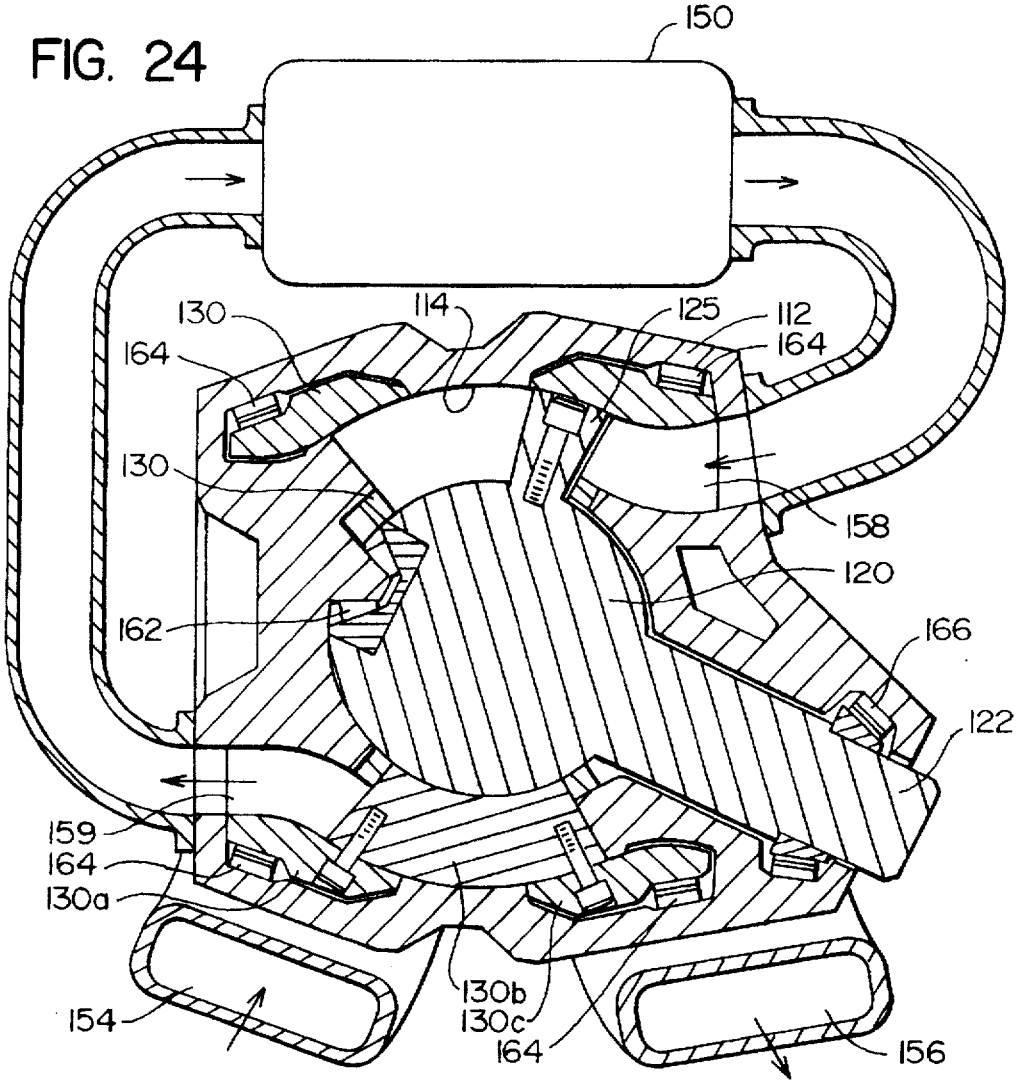
FIG. 24 is a schematic showing a combustor for use with the engine of FIG. 16.

Referring to FIGS. 20, 23 and 24, passive rotor 130 may be mounted on a shaft 133 extending from housing 112, or preferably mounted to the housing with the co-ax shaft 122 supported by the passive rotor shaft 132. A bearing 162, coaxial with axis A, and against which the master rotor 120 rotates, is located at the furthest extending part of the shaft 133. In FIG. 21, the shaft 133 has been truncated to remove excess material and the outer surface 131 of the passive rotor 130 is mounted on bearings 164 disposed around the interior surface 114 of the housing 112. In FIG. 22, shaft 122 is supported at both ends on bearings 166, 162, while the passive rotor 130 has been made from two parts 130*a* and 130*b* bolted together to provide ease of assembly and resistance to centrifugal expansion of the passive rotor 130.

In FIG. 23, the passive rotor 130 is made from a first annular rotor portion 130*a* and second annular rotor portion 130*c* at opposite sides of the housing, to which are bolted rotor segments 130*b* that separate the chambers 140. The annular rotor portions 130*a* and 130*c* are supported for rotation in relation to the housing 112 on the bearings 164. The annular rotor portions 130*a* and 130*c* are shown as being symmetrical, but need not be. An expansion port 158 and compression port 159 are provided that pass through the passive rotor 130 and housing 112. In addition, pistons 125 are bolted to the power rotor 120. In this manner, the mass of the passive rotor 130 has been reduced as much as possible by removing material from the rotor 130 and replacing it with added material in the non-rotating housing.

Air flow direction through the ports 158 and 159 is intended to minimize inertial energy losses of the gas flow. Inertial energy of the expanding gases entering the expansion port 158 helps push the pistons 125 and centrifugal force helps in scavenging exhaust gases, while at the compression port 159 compressed gas exiting the chamber 140*a* does not change direction as it moves from chamber to port. These modifications reduce losses due to changes in direction of gas flow in the engine. Close tolerance non contact seals may be used practicably in this design at the sealing points along the contacting faces 124 and 134. Close tolerance non contact seals are practical in this design due to its relatively high speed of operation and resulting reduction in leak-down time. It is believed that the present design may reduce contact between the power and slave rotor surfaces due to small air leakage past these surfaces, thus providing an air bearing effect.

In FIG. 24 is shown an external combustion chamber 150 and its relation to the engine of the invention as shown in FIG. 23, with expanding gas supplied to port 158 and compressed gas being output from the port 159 to the intake of the combustion chamber 150. Fuel supply and igniters for the combustion chamber are not shown, since a variety of external combustion chambers 150 and fuels could be used with the engine of the invention.

Generally, the number of pistons is a matter of choice and depends to some extent on the offset angle of the rotors. In addition, the offset of the axes A and B must not be so great that too much of the material of the passive rotor is removed, with a preferred limitation of around 45°, nor, in the case of the embodiment of FIG. 24, be so small that the force in the expansion chamber 140*b* is too small to overcome frictional forces on the rotors. The port sizes and shapes may also be varied depending on flow requirements, although for the engine as with the pump, the port peripheries preferably match the chamber edges as the chambers cross the ports. The invention is believed to provide low frictional losses, with laminar flow of gases within the engine. Intermittent cooling of the expansion chambers and pistons is believed to allow use of high temperatures without use of excessively expensive temperature resistant materials.

A further embodiment of an engine according to the invention is shown in FIG. 25. In this embodiment, an offset first rotor 220 and second rotor 230 are seen from directly above top dead centre, each including contoured faces 224 and 234 respectively. The rotor 220 and rotor 230 may be master or slave, depending on the manner of use. The contoured faces 224 of the first rotor include first pairs of opposed contact faces 224*a*, 224*b*. Each contact face 224*a*, 224*b* is defined by the locus formed as the rotors rotate about their respective axes by points on the slave rotor. The points are those on the sides of the conical piston 244 forming part of the second rotor 230, and corresponding to the conceptual cone of FIGS. 3A–3C. The opposed contact faces 224*a*, 224*b* 224, 234 define a chamber 240*a*, 240*b*, between them. Several such chambers 240*a*, 240*b*, and conical pistons 244 may be formed around the first rotor 220 and second rotor 230. Like chambers 240*a*, 240*b* may also be formed in the second rotor 230, with corresponding conical pistons on the first rotor 220. The conical piston 244 on the second rotor 230 is connected to the main part of the second rotor 230 by a neck 245 of material, whose lateral dimensions are limited on the one hand by the size of the opening of the chamber 240*a* and on the other hand by the need to make a strong connection between the conical piston 244 and the second rotor 230. The chamber 240*a*,240*b*, thus forms a cylinder. As the rotors 220, 230 rotate about their respective axes, the conical piston 244 moves in (bottom dead centre) and out (top dead centre, shown) of the chamber 240*a*, thus changing the volume of the chambers 240. The chamber 240*a* is only sealed for a brief period of time at top dead centre. Continuous contact is made by the sides of the conical piston 244 with the sides of the chamber 240*a* during the rotation. Ports may be provided for the inflow and outflow of fluids from the chambers 240*a*, 240*b* .Material shown at 250, 251 on the rotors is configured to avoid crashing of the rotors into each other and provide the necessary structural rigidity to the chambers 240*a* and conical pistons 244.

The combustion engine is believed to provide high power to mass ratios with low fuel consumption and low harmful emissions.

A person skilled in the art could make immaterial modifications to the invention described and claimed in this patent without departing from the essence of the invention.

The embodiments of the invention in which an exclusive property or privilege is claimed are defined as follows:

1. An engine comprising:

a housing;

a first rotor mounted for rotation on the housing about a first axis, the first rotor including first contoured faces and defining at least part of a sphere having a center;

a second rotor mounted for rotation on the housing about a second axis, the second rotor including second contoured faces and defining at least part of a sphere having a common center with the center of the first rotor;

the first axis and second axis being offset from being collinear by an angle a and intersecting at the common centers of the rotors;

each contoured face including a contact face and a side face, and the contact faces and side faces define vanes that cooperate to form chambers that change volume with rotation of the first and second rotors about the first and second axes respectively;

each contact face of each rotor being defined by the locus formed as the rotors rotate about their respective axes by points on the other rotor;

the points of each rotor that define the locus lying along an outer edge of a cone whose central axis is essentially a radius extending outward from the common centers of the rotor at an angle $\alpha/2$ from a normal to the axis of the other rotor; and ports disposed to allow fluid flow in and out of the chambers.

2. The engine of claim 1 in which the apex of the cone is essentially at the common center of the rotors.

3. The engine of claim 1 in which the first and second rotors face each other axially across the common center of the rotors, and the first rotor is a master rotor and the second rotor is a slave rotor.

4. The engine of claim 1 in which the housing has an interior surface defining at least a partially spherical cavity, whose center coincides with the common center of the rotors and the housing interior surface cooperates with the contoured faces of the rotors to form the chambers.

5. The engine of claim 3 in which the contact faces have axially inward and outward ends, and the side faces connect an inward end of one contact face with the outward end of an adjacent contact face.

6. The engine of claim 1 in which each rotor includes a shaft and the vanes of each rotor extend into the shaft of the other rotor.

7. The engine of claim 1 in which each rotor has at least three contoured faces, a vane being formed between each pair of adjacent contoured faces, and the contoured faces of both rotors defining at least three chambers.

8. The engine of claim 1 in which points on each rotor on the central axis of the cone follow a teardrop shape locus having an inflection point when the points cross a plane passing through the common center of the rotors and perpendicular to the axis of the other rotor.

9. The engine of claim 1 in which opposed contact faces of adjacent vanes define secondary chambers, the secondary chambers being sealed by contact of tips of the vanes of each rotor with the contoured faces of the other rotor and pockets are formed in each rotor at axially inward ends of each contact face at the point of contact of the tips of the vanes of each rotor with the contoured faces of the other rotor.

10. The engine of claim 1 in which the vanes have continual contact with the contact faces of the corresponding chambers as the rotors rotate about their respective axes.

11. The engine of claim 1 in which opposed side faces define primary chambers and opposed contact faces define secondary chambers, and the ratio of the primary chamber maximum volume to the primary chamber minimum volume is less than 7:1.

12. The engine of claim 1 in which opposed side faces define primary chambers and opposed contact faces define secondary chambers, and the side faces extend into each rotor in which they are formed beyond the locus formed by a cone on the other rotor as the rotor rotates.

13. The engine of claim 1 in which the first rotor has the same profile as the second rotor.

14. The engine of claim 1 in which opposed side faces define primary chambers and opposed contact faces define secondary chambers, and the secondary chamber seals only momentarily at the point of minimum volume of the secondary chamber.

15. The engine of claim 1 in which there are at least three vanes.

16. The engine of claim 1 in which:

the first rotor has a rotor contact end and the rotor contact end of the first rotor is surrounded by the second rotor;

each contoured face of the first rotor includes a pair of contact faces and side faces connecting the contact faces to thereby define a piston; and each contoured face of the second rotor includes a pair of contact faces and side faces connecting the contact faces to thereby define a cylinder, one cylinder corresponding to each piston.

17. The engine of claim 16 in combination with an external combustion chamber and the ports include:

an expansion port at the top of the rotors connected to the external combustion chamber;

a compression port at the bottom of the rotors connected to the external combustion chamber;

an intake port on the side of the engine in which the rotors move from bottom to top; and an exhaust port on the side of the engine in which the rotors move from bottom to top.

18. The engine of claim 17 in which the ports are disposed within the second rotor.

19. The engine of claim 17 in which the expansion port and the compression port are on opposite sides of a plane bisecting the first and second axes.

20. The engine of claim 1 in which the vanes have tips and the tips of the vanes, on the side opposite to the contact face, include additional wear material.

21. The engine of claim 1 further including a power source connected to drive one of the first and second rotors.

22. A method of making a rotor for use in an engine, in which the engine includes a housing having an interior surface defining at least a partially spherical cavity, the cavity having a center; a first rotor mounted for rotation within the housing about a first axis, the first rotor including first faces; a second rotor mounted for rotation within the housing about a second axis, the second rotor including second faces; the first axis and second axis being offset from being collinear by an angle a and intersecting at the center of the cavity; the method comprising the steps of:

obtaining a rotor body having external rotational symmetry; and contouring the faces of the first and second rotors so that:

the faces of the first and second rotors cooperate with each other and the interior surface of the housing to form chambers that change volume with rotation of the first and second rotors about the first and second axes respectively; and each contoured face includes a side face and a contact face defining a vane between them, and each contact face of each one rotor is shaped by cutting away material from that rotor on one side of a locus formed as the rotors complete one revolution about their respective axes by points on the other rotor lying along an outer edge of a cone whose central axis is a radius extending outward from the center of the cavity at an angle $\alpha/2$ from a normal to the axis of the other rotor.

23. The method of claim 22 in which the apex of the cone is at the center of the cavity.

24. The method of claim 22 in which each side face is formed by removing material from each rotor between adjacent contact faces to render the side faces concave.

25. The method of claim 22 in which the side faces are extended into each rotor in which they are formed beyond the locus formed by a cone on the other rotor as the rotor rotates.

26. An engine having a housing, a first rotor mounted for rotation on the housing about a first axis, the first rotor including first contoured faces and defining at least part of a sphere having a center, a second rotor mounted for rotation on the housing about a second axis, the second rotor including second contoured faces and defining at least part of a sphere having a common center with the center of the first rotor, the first axis and second axis being offset from being collinear by an angle $\alpha$ and intersecting at the common centers of the rotors, ports being disposed inside the housing to allow fluid flow in and out of the chambers, characterized in that:

each contoured face includes a contact face and a side face, and the contact faces and side faces define vanes that cooperate to form chambers that change volume with rotation of the first and second rotors about the first and second axes respectively;

each contact face of each rotor is defined by the locus formed as the rotors rotate about their respective axes by points on the other rotor;

the first and second rotors face each other axially across the common center of the rotors;

the first rotor is a master rotor and the second rotor is a slave rotor; and each rotor includes a shaft and the vanes of each rotor extend into the shaft of the other rotor.

27. An engine having a housing, a first rotor mounted for rotation on the housing about a first axis, the first rotor including first contoured faces and defining at least part of a sphere having a center, a second rotor mounted for rotation on the housing about a second axis, the second rotor including second contoured faces and defining at least part of a sphere having a common center with the center of the first rotor, the first axis and second axis being offset from being collinear by an angle $\alpha$ and intersecting at the common centers of the rotors, ports being disposed inside the housing to allow fluid flow in and out of the chambers, characterized in that:

the first rotor has a rotor contact end and the rotor contact end of the first rotor is surrounded by the second rotor;

each contoured face of the first rotor includes a pair of contact faces and side faces connecting the contact faces to thereby define a piston;

each contoured face of the second rotor includes a pair of contact faces and side faces connecting the contact faces to thereby define a cylinder, one cylinder corresponding to each piston; and each contact face of each cylinder is defined by the locus formed as the rotors rotate about their respective axes by points on the contact faces of the corresponding piston, whereby the pistons and cylinders cooperate to form chambers that change volume with rotation of the first and second rotors about the first and second axes respectively.

28. The engine of claim 27 in which each contact face of each piston is defined by a segment of a cone whose central axis is a radius extending outward from the common centers of the rotor and the central axes of the cones defining contact faces for each piston lie on opposite sides of a plane bisecting the first and second axes.29. The engine of claim 27 in which the housing has an interior surface defining at least a partially spherical cavity, whose center coincides with the common center of the rotors and the housing interior surface cooperates with the contoured faces to form the chambers.30. The engine of claim 27 in which the contact faces have axially inward and outward ends, and the side faces connect an inward end of one contact face with the outward end of an adjacent contact face. 31. The engine of claim 27 in combination with an external combustion chamber and further including:

an expansion port at the top of the rotors connected to the external combustion chamber;

a compression port at the bottom of the rotors connected to the external combustion chamber;

an intake port on the side of the engine in which the rotors move from bottom to top; and an exhaust port on the side of the engine in which the rotors move from bottom to top.32. The engine of claim 31 in which the ports are disposed within the second rotor.33. The engine of claim 32 in which the expansion port and the compression port are on opposite sides of the plane bisecting the first and second axes.34. An engine having a housing, a first rotor mounted for rotation on the housing about a first axis, the first rotor including first contoured faces and defining at least part of a sphere having a center, a second rotor mounted for rotation on the housing about a second axis, the second rotor including second contoured faces and defining at least part of a sphere having a common center with the center of the first rotor, the first axis and second axis being offset from being collinear by an angle $\alpha$ and intersecting at the common centers of the rotors, ports being disposed inside the housing to allow fluid flow in and out of the chambers, characterized in that:

each contoured face includes a contact face and a side face, and the contact faces and side faces define vanes that cooperate to form chambers that change volume with rotation of the first and second rotors about the first and second axes respectively;

the first rotor has a rotor contact end and the rotor contact end of the first rotor is surrounded by the second rotor;

the housing has an interior surface defining at least a partially spherical cavity, whose center coincides with the common center of the rotors and the housing interior surface cooperates with the contoured faces to form the chambers;

the second rotor is supported by bearings disposed between the second rotor and the housing; and the second rotor is formed from a first annular portion supported by a first set of bearings at one end of the housing, a second annular portion supported by a second set of bearings at the other end of the housing and plural segments fixed to each of the first and second annular portions, the plural segments separating the chambers. 35. An engine comprising:

a housing having an interior cavity which is partially spherical;

a passive rotor mounted for rotation within the housing about an axis B and having contoured faces defining radially extending cylinders;

a power rotor mounted for rotation within the passive rotor about an axis A and having pistons extending radially from the power rotor, one piston extending into each cylinder, each piston being defined by contact faces and side faces;

axis A and axis B meeting at the center of the interior cavity and being at an angle a to each other; and the contact faces and side faces of the pistons, the contoured faces of the cylinders, and interior surface of the cavity together defining chambers that change volume as the rotors rotate about their respective axes. 36. The engine of claim 35 in which:

the contoured faces of the cylinders include contact faces and side faces, the contact faces of the cylinders being defined by the locus of movement of points on the contact faces of the pistons as the power rotor and passive rotor rotate in relation to each other;

the side faces of each piston and cylinder connecting opposed contact faces of each piston and cylinder respectively; and opposed piston contact faces of each piston being defined by respective first and second arcs centered on opposed sides of a plane H bisecting the axes A and B.37. The engine of claim 36 in which the center of the first arc defines a plane on rotation that intersects the plane H at bottom dead center and the center of the second arc defines a plane on rotation that intersects the plane H at top dead center.38. The engine of claim 37 in which an expansion port for the flow of gases into the chambers is provided at the top of the engine at one side of the engine and a compression port for the flow of compressed gases out of the chambers is provided at the bottom of the engine at the other side of the engine.39. The engine of claim 38 in which the passive rotor is mounted on a shaft extending away from the housing towards the power rotor, and the slave rotor rotates against a bearing located at the end of the shaft.40. The engine of claim 39 in which the bearing encompasses both the slave rotor and the power rotor. 41. The engine of claim 40 in which the rotors rotate in the same direction and contact faces of the pistons contact the contact faces of the cylinders as the pistons move 180° and do not contact the contact faces of the cylinders as the pistons move a further 180°.42. An engine having a housing, a first rotor mounted for rotation on the housing about a first axis, the first rotor including first contoured faces and defining at least part of a sphere having a center, a second rotor mounted for rotation on the housing about a second axis, the second rotor including second contoured faces and defining at least part of a sphere having a common center with the center of the first rotor, the first axis and second axis being offset from being collinear by an angle $\alpha$ and intersecting at the common centers of the rotors, ports being disposed inside the housing to allow fluid flow in and out of the chambers, characterized in that:

each contoured face includes a contact face and a side face, and the contact faces and side faces define vanes that cooperate to form chambers that change volume with rotation of the first and second rotors about the first and second axes respectively; and in which opposed side faces define primary chambers and opposed contact faces define secondary chambers, and the side faces extend into each rotor in which they are formed beyond the locus formed by a cone on the other rotor as the rotors rotate, in which the cone has an axis and the axis of the cone passes through the common center of the rotors. 43. The engine of claim 42 further including a power source connected to drive one of the first and second rotors.

* * * * *